US009994040B2

(12) United States Patent
Karita et al.

(10) Patent No.: US 9,994,040 B2
(45) Date of Patent: Jun. 12, 2018

(54) LIQUID EJECTION APPARATUS, LIQUID EJECTION METHOD, AND LIQUID EJECTION HEAD

(71) Applicant: CANON KABUSHIKI KAISHA, Tokyo (JP)

(72) Inventors: Seiichiro Karita, Saitama (JP); Shuzo Iwanaga, Kawasaki (JP); Kazuhiro Yamada, Yokohama (JP); Takatsuna Aoki, Yokohama (JP); Shingo Okushima, Kawasaki (JP); Akio Saito, Machida (JP); Akira Yamamoto, Yokohama (JP); Zentaro Tamenaga, Sagamihara (JP); Noriyasu Nagai, Tokyo (JP); Tatsurou Mori, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/435,540

(22) Filed: Feb. 17, 2017

(65) Prior Publication Data

US 2017/0239956 A1 Aug. 24, 2017

(30) Foreign Application Priority Data

Feb. 23, 2016 (JP) ..... 2016-032351

(51) Int. Cl.
*B41J 2/18* (2006.01)
*B41J 2/19* (2006.01)
(Continued)

(52) U.S. Cl.
CPC ..... *B41J 2/19* (2013.01); *B41J 2/1707* (2013.01); *B41J 2/185* (2013.01); *B41J 2/195* (2013.01); *B41J 2002/1853* (2013.01)

(58) Field of Classification Search
CPC .. B41J 2/16232; B41J 2/1707; B41J 2/17566; B41J 2/17596; B41J 2/18; B41J 2/185; B41J 2/19; B41J 2/1951; B41J 2002/185
See application file for complete search history.

(56) References Cited

U.S. PATENT DOCUMENTS 6,871,925 B2 * 3/2005 Yamamoto ..... B41J 2/17566 347/19
8,132,902 B2 * 3/2012 Shibata ..... B41J 2/17509 347/89

(Continued)

FOREIGN PATENT DOCUMENTS

JP 2005125670 * 5/2005 ..... B41J 2/175
JP 2013-022886 A 2/2013

*Primary Examiner* — Anh T. N. Vo
(74) *Attorney, Agent, or Firm* — Fitzpatrick, Cella, Harper & Scinto

(57) ABSTRACT

The liquid ejection apparatus includes a circulation unit configured to circulate a liquid along a circulation passage extending from a liquid supply source to the liquid supply source through a liquid ejection head. Further, the liquid ejection apparatus includes a deaeration unit configured to perform a deaeration operation of decreasing a dissolved gas amount of the liquid, a recovery unit configured to recover ejection performance of an ejection opening, and a control unit configured to control an operation of driving the circulation unit and the deaeration unit. The control unit starts the deaeration operation and circulates the liquid having been deaerated by the deaeration operation inside a circulation path after the recovery operation and before an initial printing operation after the recovery operation.

20 Claims, 31 Drawing Sheets

(51) Int. Cl.

| | |
|---|---|
| ***B41J 2/195*** | (2006.01) |
| ***B41J 2/185*** | (2006.01) |
| ***B41J 2/17*** | (2006.01) |

(56) References Cited

U.S. PATENT DOCUMENTS 8,807,726 B2 * 8/2014 Doi ..... B41J 29/38
347/92
8,974,046 B2 * 3/2015 Ooishi ..... B41J 2/175
347/7
9,242,475 B2 * 1/2016 Otsuka ..... B41J 2/17596

* cited by examiner

FIG.30A
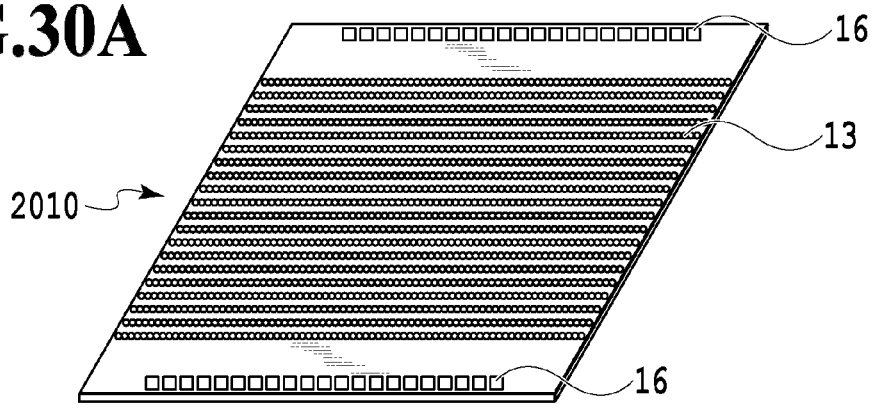
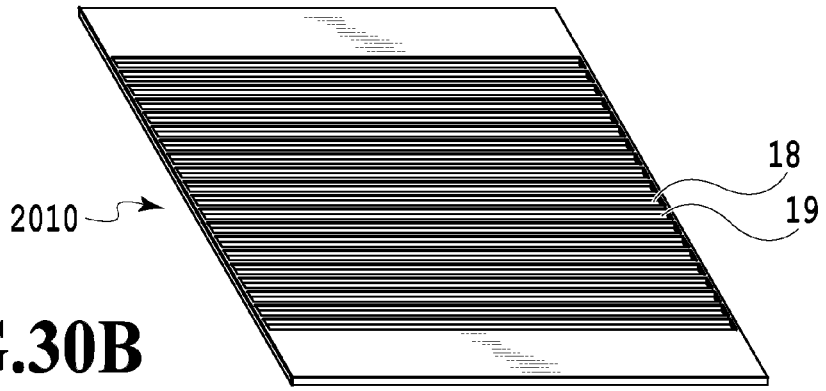
FIG.30B
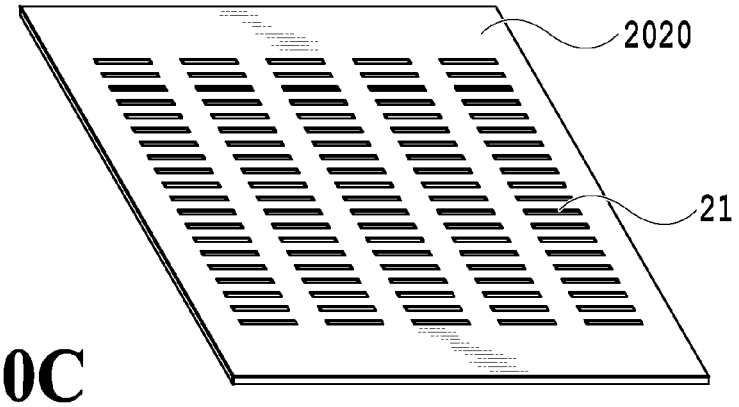
FIG.30C

LIQUID EJECTION APPARATUS, LIQUID EJECTION METHOD, AND LIQUID EJECTION HEAD

BACKGROUND OF THE INVENTION

Field of the Invention

The present invention relates to a liquid ejection apparatus including a liquid supply unit supplying a liquid to a liquid ejection head including an ejection opening ejecting a liquid droplet and also relates to a liquid ejection method and a liquid ejection head.

Description of the Related Art

As a recent liquid ejection apparatus, there is known an inkjet printing apparatus which forms an image by ejecting a liquid including a color material or a liquid (hereinafter, referred to as ink) such as a treatment liquid for adjusting quality of an image to be printed. In the inkjet printing apparatus, a predetermined amount of a gas is normally dissolved in the ink inside a liquid ejection head or an ink passage connected to the liquid ejection head. In a case where the gas dissolved in the ink becomes bubbles and the bubbles grow inside the passage or the liquid ejection head, the flow of the ink is disturbed or the ink ejection performance from an ejection opening is degraded, whereby a defective image is obtained.

For this reason, a suction recovery operation is performed on the inkjet printing apparatus in order to remove bubbles mixed with the ink in such a manner that the ink is forcibly collected from the inside of a passage or an ejection opening of a printing head by a depressurization operation while the ejection opening of the liquid ejection head is covered by a cap. The suction recovery operation is performed at a predetermined time interval in consideration of the generation/growth of the bubbles after the precedent suction operation. In a case where the worst condition, involving the generation of bubbles of the ink, is supposed and the recovery operation interval is set to prevent an ejection failure even in such a condition, a problem arises in that an amount of wasted ink increases since the frequency of performing the suction recovery operation increases.

As a technology of solving such a problem, Japanese Patent Laid-Open No. 2013-22886 discloses a method of controlling a recovery operation on the basis of a gas amount inside a passage forming member before ink is charged into an ink passage and a balanced gas amount inside the passage forming member after the ink is charged into the ink passage.

However, even when a suction recovery process or the like is performed in a case where the printing head is first driven after the installation of the inkjet printing apparatus, there is a possibility that bubbles may remain while not being sufficiently removed from the printing head or the ink passage. Then, there is a high possibility that the remaining bubbles may grow due to permeation from resin and a formation from saturated ink. Further, there is a case in which the circulation of the ink in the ink passage is interrupted or the ejection of the ink from the ejection opening is suppressed by the growing bubbles. Particularly, since bubbles adsorbed to resin in a resin passage are formed in a case where the ink is charged for use from a dry initial state in which the ink is not charged, the bubbles are easily generated and expanded. For this reason, there is a possibility that the bubbles may remain even after the suction recovery process or the like.

Thus, even in the technology disclosed in Japanese Patent Laid-Open No. 2013-22886, there is a need to frequently perform the recovery operation at an initial stage in which many bubbles are formed from the passage. When the frequency of performing the recovery operation increases, a waste ink amount increases. Accordingly, a running cost caused by the consumption of the ink increases and the capacity of the waste ink tank needs to be increased.

SUMMARY OF THE INVENTION

An object of the invention is to provide a liquid ejection apparatus, a liquid ejection printing method, and a liquid ejection head capable of decreasing a liquid consumption amount and suppressing an increase in size of a waste liquid tank by causing a deaerated liquid to flow after a recovery operation to remove bubbles inside a passage.

According to the invention, there is provided a liquid ejection apparatus that performs a printing operation on a printing medium by ejecting a liquid from an ejection opening formed in a liquid ejection head, the liquid ejection apparatus including: a circulation unit configured to circulate the liquid inside a circulation passage extending from a liquid supply source to the liquid supply source through the liquid ejection head; a deaeration unit configured to perform a deaeration operation of decreasing a dissolved gas amount of the liquid; a recovery unit configured to perform a recovery operation of discharging the liquid from the ejection opening in order to recover liquid ejection performance from the ejection opening; and a control unit configured to control an operation of driving the circulation unit and the deaeration unit, wherein the control unit starts the deaeration operation and circulates the liquid having been deaerated by the deaeration operation inside a circulation path after the recovery operation and before an initial printing operation after the recovery operation.

Further, according to the invention, there is provided a liquid ejection method of performing a printing operation on a printing medium by ejecting a liquid from an ejection opening formed in a liquid ejection head while circulating the liquid inside a circulation passage extending from a liquid supply source to the liquid supply source through the liquid ejection head, the liquid ejection method including: a recovery step of performing a recovery operation of discharging the liquid from the ejection opening in order to recover liquid ejection performance from the ejection opening; a deaeration step of performing a deaeration operation of decreasing a dissolved gas amount of the liquid after the recovery operation and before an initial printing operation after the recovery step; and a circulation step of circulating the liquid having been deaerated by the deaeration operation inside the circulation passage.

Further, according to the invention, there is provided a liquid ejection head that is included in the above-described liquid ejection apparatus, wherein the liquid ejection head includes an ejection opening ejecting a liquid, a print element generating energy used to eject a liquid, and a pressure chamber having the print element provided therein and a liquid inside the pressure chamber is circulated to the outside of the pressure chamber.

According to the invention, it is possible to decrease a liquid consumption amount and suppress an increase in size of a waste liquid tank by causing a deaerated liquid to flow after a recovery operation to remove bubbles inside a passage.

Further features of the present invention will become apparent from the following description of exemplary embodiments (with reference to the attached drawings).

BRIEF DESCRIPTION OF THE DRAWINGS

FIGS. 30A, 30B, and 30C are schematic diagrams illustrating a print element board and a cover plate.

DESCRIPTION OF THE EMBODIMENTS

Hereinafter, embodiments of the invention will be described with reference to the drawings.

First Embodiment

Figure 1:
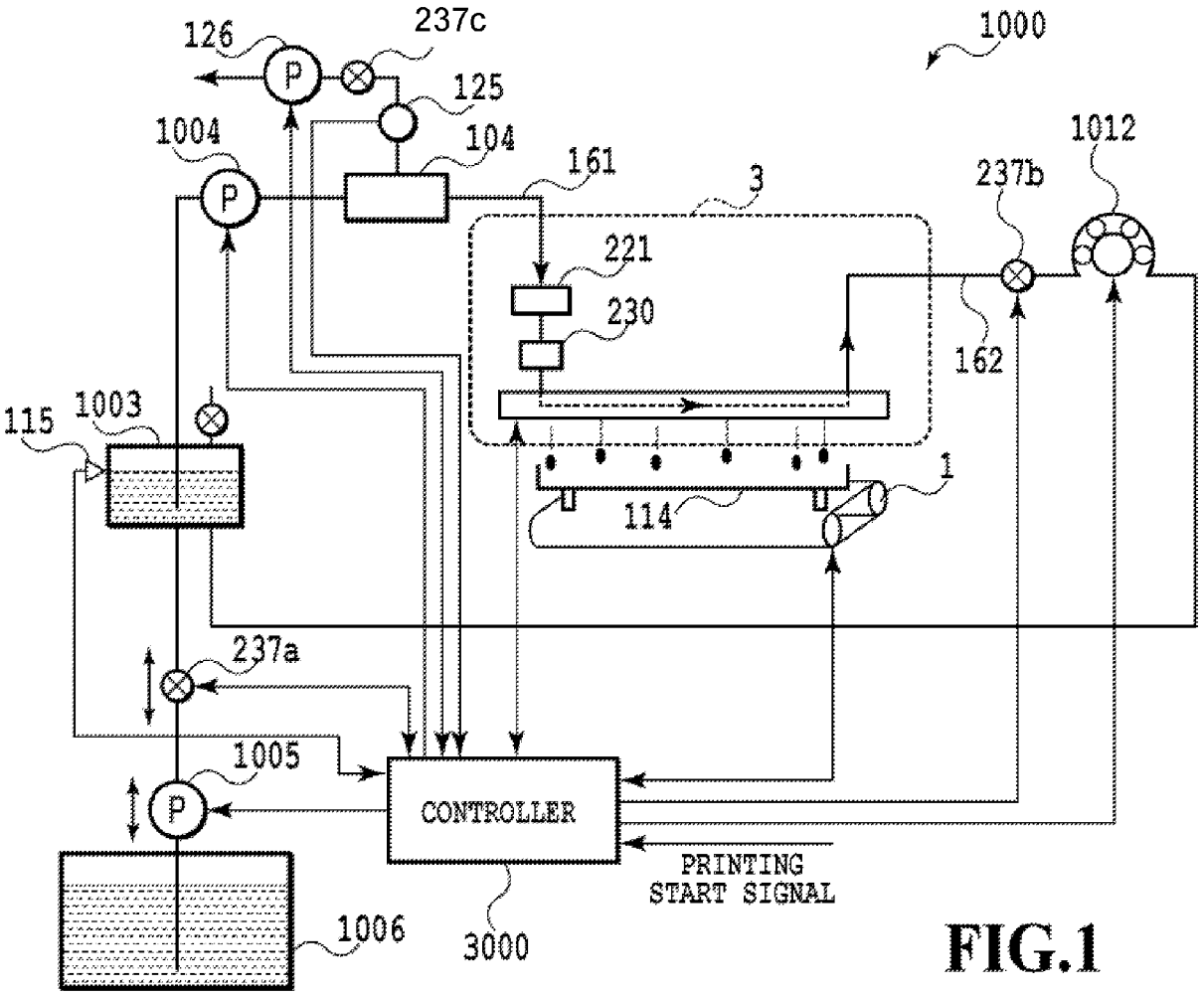
FIG. 1 is a side view illustrating a schematic configuration of a liquid ejection apparatus of an embodiment of the invention.

FIG. 1 is a side view illustrating a schematic configuration of a liquid ejection apparatus of an embodiment of the invention. The liquid ejection apparatus illustrated herein is in the configuration of an inkjet printing apparatus (hereinafter, referred to as a printing apparatus) 1000 which ejects ink to perform a printing operation. The printing apparatus according to the embodiment can be applied to a printer, a copying machine, a facsimile having a communication system, a word processor having a printer, and an industrial printing apparatus combined with various processing devices. For example, the printing apparatus can be used to manufacture a biochip or print an electronic circuit.

The printing apparatus 1000 includes a conveying unit 1 which conveys a printing medium 2, a line type liquid ejection head 3 which is disposed to be substantially orthogonal to a conveying direction of the printing medium 2, a liquid supply unit which supplies a liquid such as ink to the liquid ejection head 3, and a controller (a control unit) 3000.

As the printing medium 2, a cut sheet or a continuous roll medium can be used. The printing apparatus of the embodiment is configured as a full line type inkjet printing apparatus which performs a printing operation through one passage while continuously or intermittently conveying the printing medium 2. The liquid ejection head 3 forms an elongated ejection opening row on the whole by disposing a plurality of print element boards 10 in an ejection opening arrangement direction, and each of the print element boards has a plurality of ejection openings arranged in a direction (in the embodiment, an orthogonal direction) intersecting a printing medium conveying direction. A print element, which generates ejection energy used to eject a liquid such as ink, is provided inside each of the ejection openings. When the print element is driven on the basis of control data and binary image data for printing an image, the ink charged in the ejection opening can be ejected toward the printing medium 2 in the form of a liquid droplet. In the embodiment, each of the print element boards 10 is provided with an ejection opening row which ejects inks of cyan C, magenta M, yellow Y, and black K. Then, a full-color image can be printed by the ink ejected from these ejection opening rows.

Further, the printing apparatus 1000 circulates the ink between a liquid supply source and the liquid ejection head 3, that is, a pressure chamber 22 inside the liquid ejection head 3. Here, the circulation of the liquid is performed by the liquid supply unit. The liquid supply unit includes a tank (a buffer tank) 1003 which serves as a liquid supply source. Further, the liquid supply unit includes an upstream common passage 161 and a downstream common passage 162 which communicate with the liquid ejection head 3, first and second circulation pumps 1004 and 1012 (circulation units), and a deaeration unit which is provided at the upstream side of the liquid ejection head 3. The deaeration unit basically includes a deaeration module 104 which is provided between the first circulation pump 1004 and the liquid ejection head 3 and a depressurization pump 126 which generates a negative pressure in the deaeration module 104. Further, the deaeration unit of the embodiment includes a valve 237*c* which communicates and interrupts the depressurization pump 126 and the deaeration module 104 with and from each other and a pressure sensor 125 which detects a pressure inside the deaeration module. A pressure detected by the pressure sensor 125 is input to the controller 3000. Further, a main tank 1006 is connected to a buffer tank 1003 through an opening/closing valve 237*a* and a replenishing pump 1005. When the replenishing pump 1005 is driven and the valve 237*a* is opened, the ink can be supplied from the main tank 1006 to the buffer tank 1003. Further, the buffer tank 1003 is provided with a liquid level sensor 115, whereby a liquid level of the ink stored in the buffer tank 1003 is detected.

The controller 3000 serves as a control unit which includes a CPU, a ROM, a RAM, and an input/output device and controls the driving of the components of the printing apparatus. That is, the controller 3000 controls the driving of the first and second circulation pumps 1004 and 1012, the replenishing pump 1005, and the depressurization pump 126, the opening/closing of the valves 237*a*, 237*b*, and 237*c*, the driving of the print element of the liquid ejection head 3, and the driving of the conveying unit.

In the printing apparatus 1000, the charging of the ink into the liquid ejection head 3 is performed in such a manner that any one of or both the first circulation pump 1001 and the first circulation pump 1012 are driven so that the ink is supplied from the tank 1003 to the liquid ejection head 3. Further, the liquid ejection head 3 is provided with a filter 221 and a pressure control mechanism 230. Accordingly, trash in the ink supplied to the head is removed by the filter 221 and a negative pressure suitable for the ejection of the ink is applied to the ejection opening by the pressure control mechanism 230. The supplied ink passes through the passage, the pressure chamber 22, and the ejection opening 13 inside the liquid ejection head 3, flows out from the liquid ejection head 3, and is collected into the buffer tank 1003 through the downstream common passage 162. In this way, in the embodiment, the ink is circulated such that the ink inside the buffer tank 1003 returns to the buffer tank 1003 again through the liquid ejection head 3.

Figure 2:
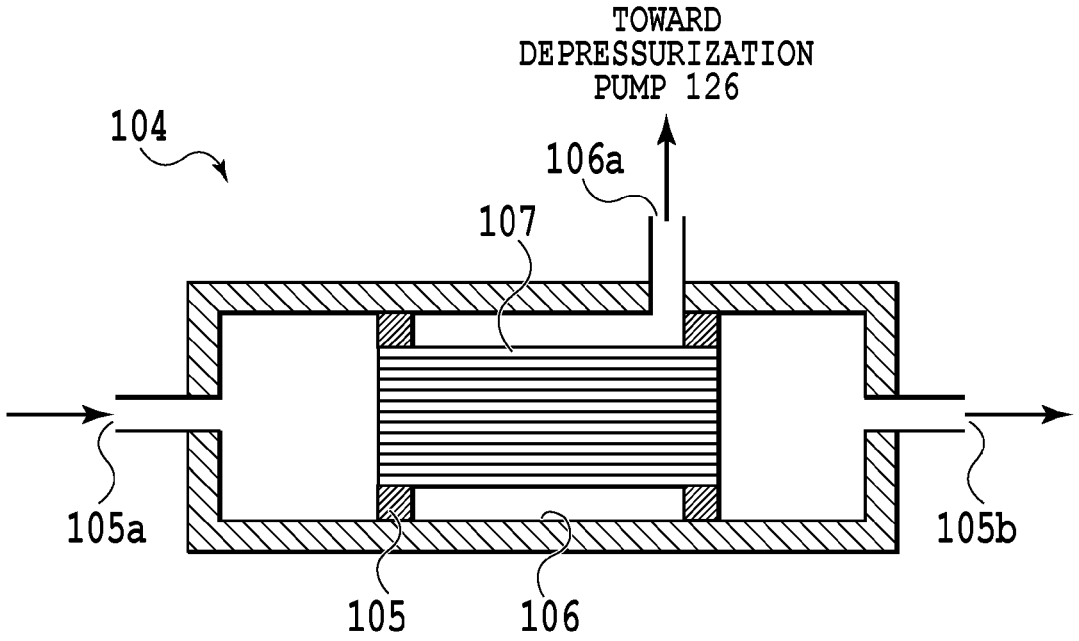
FIG. 2 is a longitudinal sectional view schematically illustrating a configuration example of a deaeration module.

The deaeration module 104 is located at the upstream side of the liquid ejection head 3 to remove a gas dissolved inside the ink fed from the buffer tank 1003. FIG. 2 is a longitudinal sectional view schematically illustrating an example configuration of the deaeration module 104. A main body 105 of the deaeration module 104 is provided with an accommodation chamber 106 which accommodates a porous hollow fiber membrane 107. A communication opening 106*a* of the accommodation chamber 106 is connected to the depressurization pump 126 through a valve 237*c* and thus a pressure inside the accommodation chamber 106 can be decreased by the driving of the depressurization pump 126.

In the deaeration module 104, the ink which flows into the main body 104*a* from an ink inflow opening 105*a* passes through the hollow fiber membrane 104*b* and flows out from an ink outflow opening 105*b*. Here, in a case where the accommodation chamber 106 is depressurized by the depressurization pump 126, a gas (such as oxygen), which is dissolved in the ink flowing into the hollow fiber membrane 104*b*, flows from the hollow fiber membrane 107 into the accommodation chamber 106, passes through the valve 237*c*, and is collected from the depressurization pump 126 to the outside. Then, the deaerated ink, from which the dissolved gas is removed at the hollow fiber membrane 104*b*, flows out from the ink outflow opening 105*b*. In this way, in the embodiment, the deaeration can be performed inside an upstream common passage extending from the buffer tank 1003 to the liquid ejection head 3. Further, the depressurization pump 126 depressurizes the deaeration module 104 so that the ink having passed through the deaeration module 104 is suppressed within a range of a desired dissolved oxygen amount. A control for a pressure inside the deaeration module 104 using the depressurization pump 126 is performed in such a manner that the controller 3000 controls the driving of the depressurization pump 126 in accordance with a pressure detected by the pressure sensor 125.

Next, a flow of the ink in the printing apparatus with the above-described configuration will be described. During the printing operation, the ink stored in the buffer tank 1003 is fed to the deaeration module 104 by the first circulation pump 1004. The deaeration module 104 is depressurized to about 80 to 60 kpa and the ink having passed through the deaeration module 104 is deaerated to a dissolved oxygen amount of about 2 to 5.5 ppm. Although there is a difference in dissolved oxygen amount in accordance with the type and the composition of the ink, the dissolved oxygen amount of the ink having passed through the buffer tank 1003 is substantially determined by a depressurization value of the deaeration module 104.

The ink having been deaerated in the deaeration module 104 is fed to the liquid ejection head 3, passes through the filter 221, passes through the pressure control mechanism 230 to be adjusted to a pressure suitable for the ejection of the ink droplet, and is led to the passage formed inside the liquid ejection head 3. A part of the ink led to the passage of the liquid ejection head 3 is supplied to the ejection opening through the pressure chamber and is ejected from the ejection opening. A non-ejected ink is collected from the liquid ejection head 3 by a metering pump 1012 and is fed to the buffer tank 1003 to be provided for the recirculation. When the ink is consumed by the ejection or the recovery, the valve 237*a* is opened at the same time when the replenishing pump 1005 is driven and then the ink is supplied from the main tank 1006 toward the buffer tank 1003 to the height of the liquid level sensor 115 provided in the buffer tank 1003. Thus, a substantially uniform amount of the ink is stored in the buffer tank 1003.

Next, a flow of the ink and an operation until the ink is charged into components so that a printing operation can be performed from a non-use state corresponding to a newly delivered state of the liquid ejection apparatus, that is, a state where the ink is not supplied to the liquid ejection head and the ink supply passage will be described. First, the replenishing pump 1005 is driven so that the ink is charged from the main tank 1006 toward the buffer tank 1003 until the liquid level of the ink is detected by the liquid level sensor 115. After the charging operation, the pressurization pump 1004 and the metering pump 1012 are driven so that the ink is charged into a circulation system including the upstream common passage 161, the liquid ejection head 3, the downstream common passage 162, and the like. At this time, the ink is charged without the adjustment of the pressure in the pressure control mechanism 230.

When the ink is charged into the circulation system, the pressure control mechanism 230 is operated to perform a suction recovery operation of forcibly suctioning and discharging the ink from the ejection opening of the liquid ejection head 3 while a negative pressure is applied to the passage or the ejection opening inside the liquid ejection head 3. In the embodiment, the suction recovery operation is performed in such a manner that a negative pressure is generated inside a cap 114 by a pump (not illustrated) while the cap 114 covers the ejection opening of the liquid ejection head 3 so that the ink is forcibly suctioned from the ejection opening. The ink having discharged into the cap 114 is discharged to a waste ink tank (a waste liquid tank) not illustrated in the drawings. When the suction recovery process is performed for a predetermined time, relatively large bubbles existing inside the ejection opening and the passage of the liquid ejection head 3 are removed so that bubbles equal to or larger than a predetermined size (a bubble diameter) are finally removed.

As described above, the suction recovery process can be performed while all of the ejection openings of the liquid ejection head are covered, but the suction recovery process can be performed while a blade capable of suctioning a part of the ejection openings moves in the longitudinal direction of the liquid ejection head. Further, there is also proposed a method of recovering a pre-charged negative pressure inside a cap at one time after all of the ejection openings are covered by the cap. Further, the ink may be forcedly discharged from the ejection opening while the passage portion is pressurized instead of the suction operation. In the invention, any kind of recovery process may be employed as long as bubbles having a predetermined size or more can be removed from the inside of the liquid ejection head.

Further, the size of the bubble to be removed by the suction recovery operation indicates a diameter which is smaller than a bubble diameter allowing the ejection of the ink from the ejection opening of the liquid ejection head and a diameter which has a predetermined allowance in consideration of the growth of the bubble. Here, a maximal value (a maximal allowable bubble diameter) of a bubble allowing the ejection of the ink, that is, a maximal diameter of the bubble not causing the non-ejection at the ejection opening indicates a diameter which is smaller than a minimal bubble diameter causing the non-ejection when the bubbles are moved by the ink flow directed toward the ejection opening inside the passage and generated by the ejection. Further, a maximal bubble which can be used for a printing operation may be set such that a diameter of the bubble in a cross-section of the passage (here, a maximal diameter indicates a long-side dimension when the bubble has an oval shape) is smaller than a maximal dimension of the passage and the passage is not blocked by the bubble.

Figure 3:
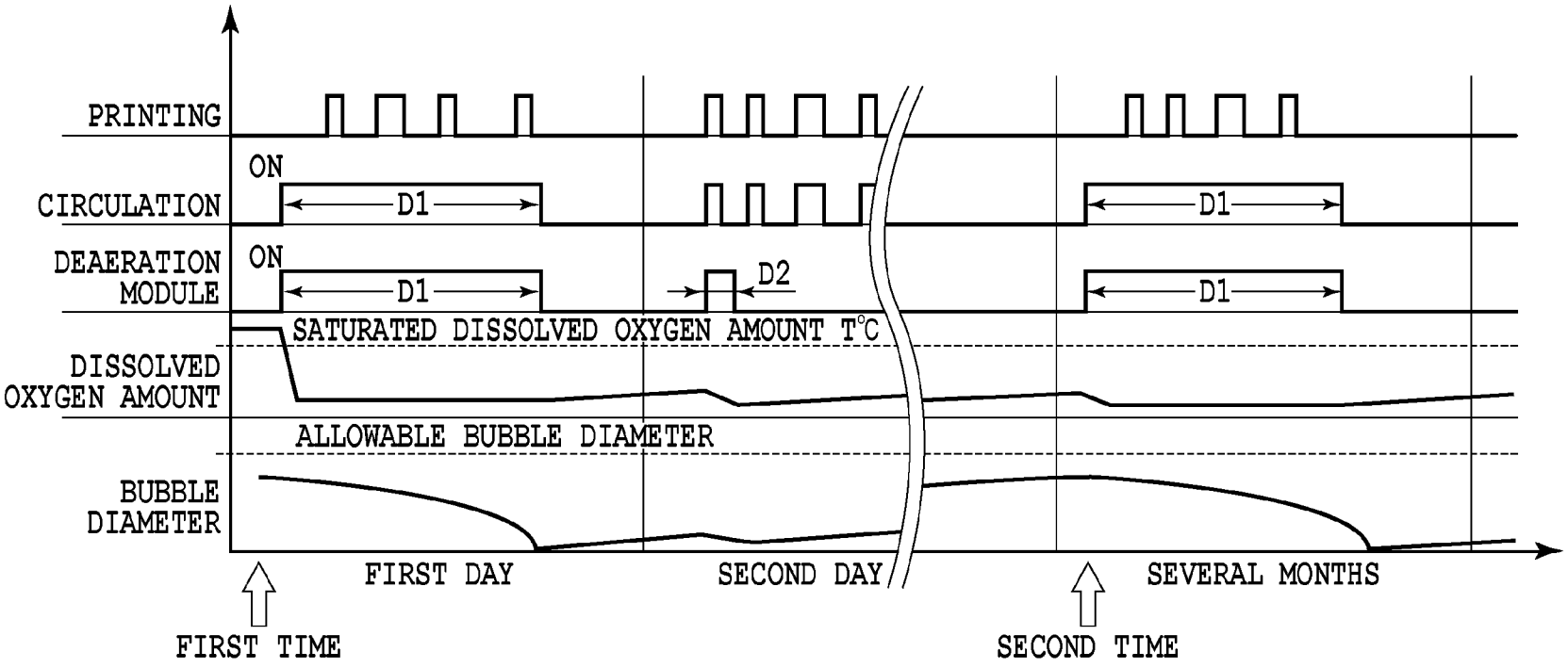
FIG. 3 is an explanatory diagram illustrating a relation between a bubble diameter inside a passage and an operation timing of each of components of a first embodiment.

FIG. 3 is an explanatory diagram illustrating a relation between a bubble diameter inside the passage and the operation timing of each of components of the embodiment. In an initial state where the printing apparatus 1000 is not used or a state immediately after the attachment or the replacement of the liquid ejection head 3, the above-described initial ink charging operation is performed and then the recovery operation is performed. According to the recovery operation after the initial charging operation, it is possible to remove a bubble having a diameter equal to or larger than the above-described maximal allowable bubble diameter. However, since a bubble having a diameter smaller than the maximal allowable bubble diameter is attached into the circulation passage or the printing head, there is a possibility that the bubble cannot be removed. The bubble which is smaller than the maximal allowable bubble diameter does not disturb the ejection of the ink from the ink ejection opening and the flow of the ink in the passage, but may disturb the ejection of the ink at the ejection opening and the flow of the ink in the passage while the bubbles are combined with one another to increase in size as time goes by. Further, since a gas is included in the ink or the resin forming the passage, the gas forms bubbles. Thus, there is a possibility that the bubbles may increase in size when the bubbles are combined with the bubbles remaining after the recovery operation or the formed bubbles are combined with one another.

Here, in the embodiment, as illustrated in FIG. 3, the deaeration process is performed by the deaeration module 104 at the same time when the ink is circulated for a predetermined time before an initial printing operation starts after the initial charging operation and the recovery operation. The circulation of the ink is performed by the driving of the first circulation pump 1004 and the metering pump 1012. Further, the deaeration process is performed while the accommodation chamber 106 of the deaeration module 104 is depressurized by the depressurization pump 126. The circulation operation and the deaeration process for the ink immediately after the initial charging operation are continuously performed for an execution time D1. The execution time D1 for the circulation operation and the deaeration process indicates a time which is necessary to remove the bubbles remaining inside the passage by the circulation of the ink (the deaerated liquid) having been deaerated by the deaeration module after the initial charging operation and the recovery process.

The deaeration ability of the deaeration module 104 is adjusted by a depressurization value given to the accommodation chamber 106 and the dissolved oxygen amount of the ink having passed through the deaeration module is determined by the depressurization value. In the embodiment, the depressurization value is set so that the dissolved oxygen amount does not reach a saturation amount (a saturated dissolved gas amount) even when a temperature in use of the liquid ejection head becomes a maximal temperature (a maximal use temperature) (the remaining bubbles grow) in the use environment of the liquid ejection head.

When a signal (a printing start signal) instructing the start of the printing operation is input to the controller 3000 after the circulation operation starts, it becomes a printing operation state while the circulation operation is maintained. A bubble trapping time (a circulation time) after the recovery operation is determined by the bubbles remaining after the recovery operation, the bubble diameter allowing the circulation of the ink in the passage, the deaeration ability of the deaeration module 104, and the like. Since the deaerated ink flows inside the circulation path and the liquid ejection head 3 of the printing apparatus, the bubbles remaining in the circulation passage and the liquid ejection head 3 after the recovery operation are gradually removed while being dissolved inside the deaerated ink. In the embodiment, in a case where the remaining bubble diameter after the recovery operation is about 0.6 mm, the ink (the deaerated ink) having been deaerated so that the dissolved oxygen amount becomes about 3.6 ppm is circulated for about 1.5 hours (D1 of FIG. 3). As a result, the bubbles of the passage formed inside the liquid ejection head 3, the bubbles existing in the ejection opening, and the bubbles existing inside the upstream common passage 161 and the downstream common passage 162 are substantially removed.

As illustrated in FIG. 3, the depressurization of the deaeration module 104 (the driving of the depressurization pump 126) may be performed at a time interval to a degree (an amount smaller than at least the saturated dissolved gas amount) which does not exceed the set value of the dissolved oxygen amount. For example, since the deaeration operation is performed for a long time (D1) at a day (a first day) in which the liquid ejection apparatus starts to be used, the deaeration process for the ink is sufficiently performed. For this reason, since the dissolved oxygen amount of the ink inside the circulation path remarkably decreases at a second day, the generation of the bubbles is suppressed. Thus, even when the time of the deaeration process in accordance with the driving of the depressurization pump 126 is largely shortened compared to the first day, the generation of the bubbles can be sufficiently suppressed. Further, since a pressure inside the deaeration module is decreased through the communication opening 106*a* during the deaeration process, a moisture evaporation amount from the ink increases relatively. Since the concentration of the ink flowing through the circulation path increases in accordance with the evaporation of moisture, the printing operation of the liquid ejection head is affected. However, in the embodiment, since the deaeration process (the depressurization) after the second day is shortened as described above, the evaporation of moisture from the ink caused by the deaeration is suppressed compared to a case where the deaeration process is performed for a long time as in the first day. For this reason, since an increase in concentration of the ink inside the ink circulation system is suppressed, the thickening and the solidifying of the ink are reduced and the influence on the image density in accordance with an increase in ink concentration is reduced. Further, the durability of the deaeration module 104, that is, the durability of the hollow fiber membrane can be improved. Further, since the operation time of the depressurization pump is shortened, the consumption power decreases and the durability of the pump increases.

Figure 4:
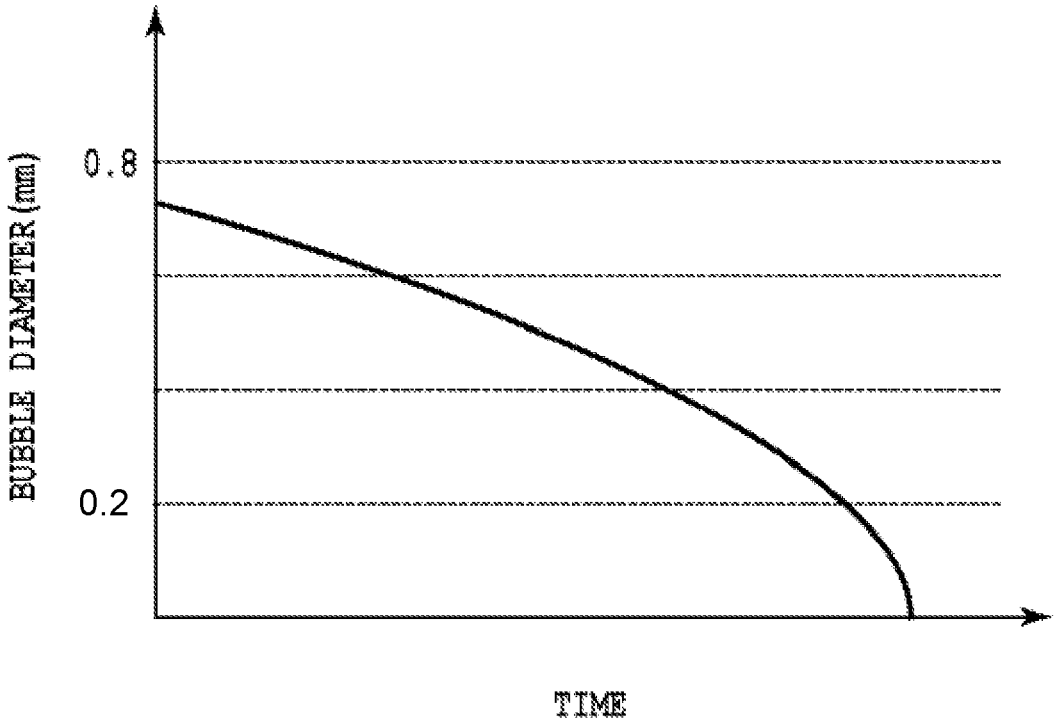
FIG. 4 is a diagram illustrating a change in bubble diameter when deaerated ink is circulated.

FIG. 4 is a diagram illustrating a change in bubble diameter during a deaerated ink circulation operation. When the bubble diameter decreases as illustrated in the drawing, the internal pressure of the bubble gradually increases so that the dissolving is promoted. Meanwhile, when the bubble diameter becomes equal to or smaller than about 0.2 mm, a speed in which the bubble decreases in size increases. Then, when the bubble decreases in size until the bubble diameter becomes equal to or smaller than about 0.2 mm, the bubbles are naturally removed due to an increase in internal pressure. For this reason, it is desirable to perform the deaeration and the circulation at the initial stage until the above-described bubble diameter is obtained.

As described above, in the embodiment, since the ink having been deaerated is circulated for a short time every one or two days so that the ink does not become a supersaturation state after the bubbles are removed by the initial deaeration and circulation, it is possible to sufficiently and appropriately maintain the liquid ejection performance of the liquid ejection head. Accordingly, it is possible to shorten the recovery period, that is, the frequency of the recovery operation. For example, even when the recovery operation which is performed at the frequency of once every week in the liquid ejection apparatus of the related art is performed at the frequency of once every several months, the liquid ejection performance of the liquid ejection head can be maintained in a satisfactory state.

Second Embodiment

Figure 5:
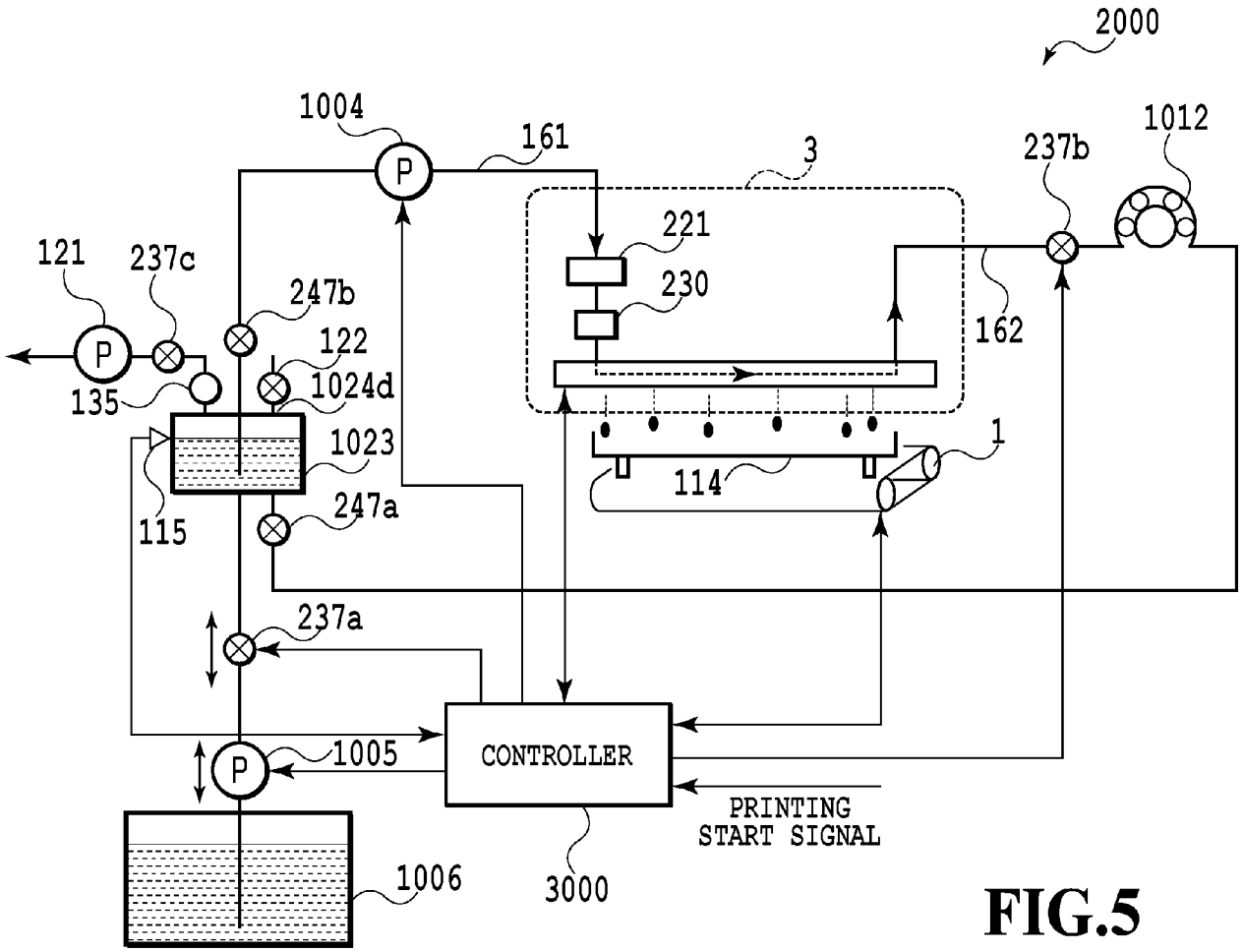
FIG. 5 is a side view illustrating a schematic configuration of a liquid ejection apparatus of a second embodiment.

Next, a second embodiment of the invention will be described. FIG. 5 is a side view illustrating a schematic configuration of a liquid ejection apparatus according to the second embodiment. Additionally, in FIG. 5, the same reference numerals will be given to the same or similar components as or to those of the first embodiment and a repetitive description thereof will be omitted. A liquid ejection apparatus 2000 of the second embodiment includes a deaeration tank 1023 which serves as a deaeration unit different from the first embodiment in which the deaeration module is provided as the deaeration unit. Since the deaeration module 104 which is generally used is relatively expensive in structure, there is a possibility that the cost of the deaeration unit in the entire cost of the small-size apparatus may increase too much. Here, in the embodiment, in order to construct a deaeration system at low cost, the deaeration tank 1023 which stores the ink supplied to the liquid ejection head 3 and performs the deaeration process on the stored ink is used. The deaeration tank 1023 includes a depressurization mechanism which depressurizes the ink storage space and a stirring mechanism which stirs the ink stored in the ink storage space.

Figure 6:
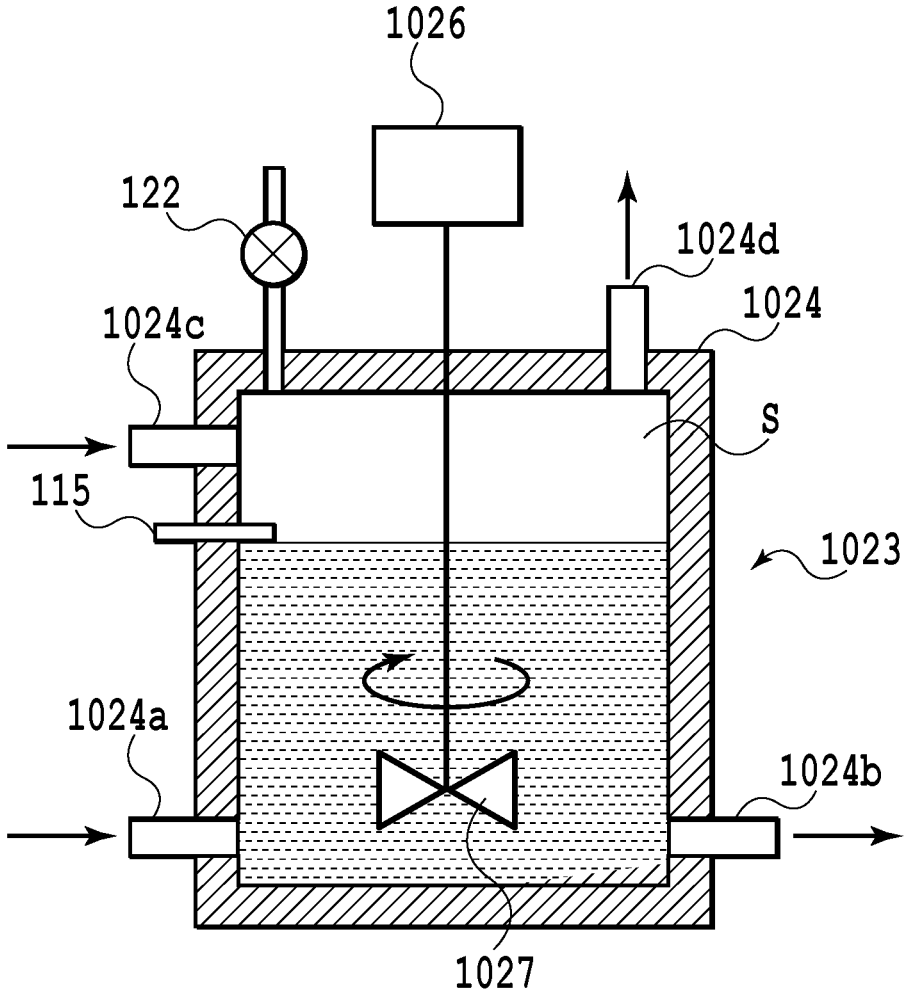
FIG. 6 is a longitudinal sectional view schematically illustrating a configuration of a deaeration tank.

FIG. 6 illustrates a configuration of the deaeration tank 1023. The deaeration tank 1023 includes a tank body 1024 which forms an ink storage space S capable of storing the ink therein. The tank body 1024 is provided with an ink inflow opening 1024*a*, an ink outflow opening 1024*b*, and an ink supply opening 1024*c*. The ink outflow opening 1024*b* is connected to the upstream side of the passage inside the liquid ejection head 3 through the pressurization pump 1004 and the ink inflow opening 1024*a* is connected to the downstream side of the passage inside the liquid ejection head 3 through the metering pump 1012 and the valve 237*b*. Further, the ink supply opening 1024*c* is connected to the main tank 1006 through the valve 237*a* and the replenishing pump 1005.

An upper portion of the tank body 1024 is provided with an atmosphere communication valve 122 which can selectively switch the communication and the interruption between the ink storage space S and the atmosphere. Further, a depressurization pump 121 capable of depressurizing the ink storage space S is connected to a depressurization opening 1024*d* formed at the upper portion of the tank body 1024. Further, the liquid level of the ink stored in the deaeration tank 1023 is detected by the liquid level sensor 115 and a detection signal indicating the detected liquid level is input to the controller 3000. Additionally, stirring piece 1027 which is rotated by a motor 1026 is provided inside the deaeration tank 1023 and the ink stored inside the deaeration tank 1023 is stirred by the rotation of the stirring piece 1027.

The supply of the ink to the deaeration tank 1023 is performed in such a manner that the controller 3000 opens the valve 237*a* and drives the replenishing pump 1005. Thus, the ink stored in the main tank 1006 is supplied to the deaeration tank 1023. When the ink supplied to the deaeration tank 1023 is detected by the liquid level sensor 115, the controller 3000 closes the valve 237*a* and stops the driving of the replenishing pump 1005. By the control of the controller 3000, a predetermined amount of the ink is normally supplied to the deaeration tank 1023.

Further, in a case where the ink supplied to the deaeration tank 1023 is deaerated, the controller 3000 closes the valves 247*a* and 247*b* respectively connected to the ink inflow opening 1024*a* and the ink outflow opening 1024*b* and the atmosphere communication valve 122. Further, the depressurization valve 237*c* connected to the depressurization pump 121 is opened. Here, the controller 3000 drives the depressurization pump 121 to start a depressurization operation inside the deaeration tank 1023 and drives the motor 1026 to rotate the stirring piece 1027 so that the ink inside the deaeration tank is stirred. By the depressurizing and stirring operations, a gas (a dissolved gas) dissolved in the ink stored in the deaeration tank 1023 is removed. In the embodiment, a contact area between the gas and the ink is widened since the ink is stirred, and the deaeration operation can be effectively performed since the ink contacting the gas inside the deaeration tank 1023 is changed. Since the deaeration process using the depressurizing and stirring operations is performed at a predetermined pressure for a predetermined time, the deaerated ink having a predetermined dissolved oxygen amount can be obtained. Additionally, a pressure inside the deaeration tank is adjusted to a predetermined pressure in such a manner that the opening and closing of the depressurization valve 237*c* is controlled by the controller 3000 on the basis of the detection pressure of the pressure sensor 135 connected to the depressurization opening 1024*d*.

Additionally, the other configurations of the second embodiment illustrated in FIG. 5, that is, the configurations of the upstream common passage 161, the liquid ejection head 3, and the downstream common passage 162 constituting the circulation passage are similar to those of the first embodiment illustrated in FIG. 1.

As described above, even in a case where the deaeration is performed by the deaeration tank 1023, it is possible to perform a deaeration substantially similarly to a case where the deaeration module 104 of the first embodiment is used in the initial deaeration stage. Then, the embodiment is similar to the first embodiment in that the bubbles remaining after the suction recovery operation are removed by the flow of the ink having been deaerated by the deaeration tank 1003 in the circulation path. However, in the second embodiment, the ink does not easily flow out from the deaeration tank 1023 being in a depressurization state toward the liquid ejection head 3 when the ink inside the deaeration tank 1023 is supplied to the liquid ejection head 3. Here, in the second embodiment, the ink storage space S of the deaeration tank 1023 is opened to the atmosphere from a depressurization state (about −80 kpa to −70 kpa). The ink storage space S is opened to the atmosphere in such a manner that the valve 122 is opened by the control of the controller 3000.

Figure 7:
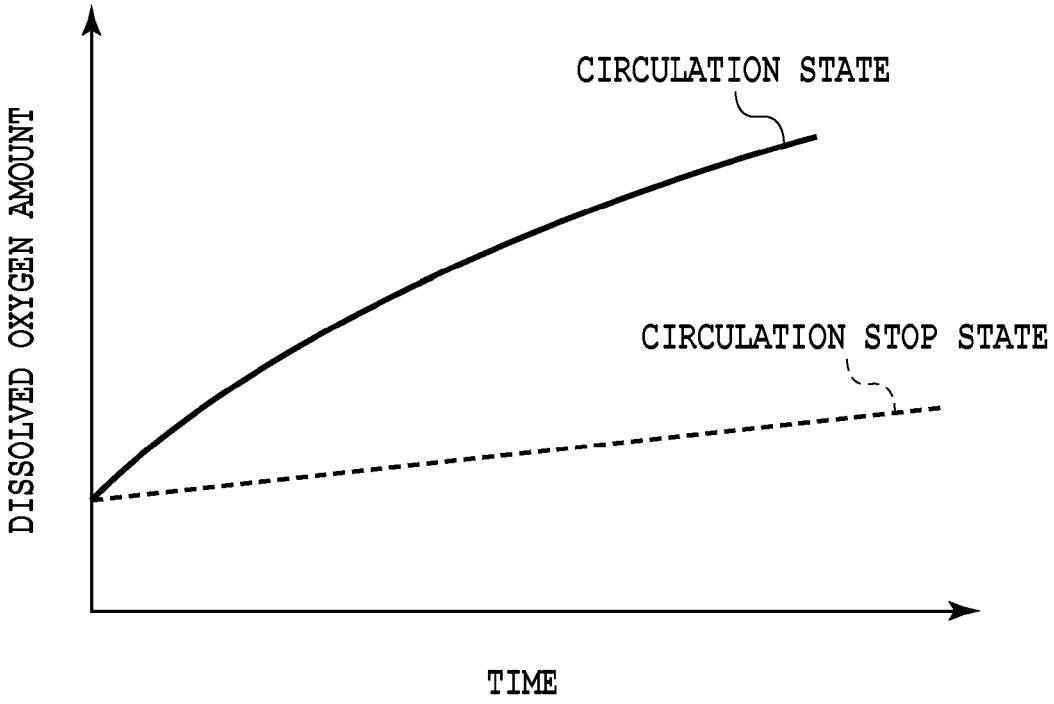
FIG. 7 is a diagram illustrating a change in dissolved oxygen amount of ink with time.

Further, since a gas is redissolved in the ink having been deaerated in the deaeration tank 1023, the dissolved oxygen amount of the ink increases as illustrated in FIG. 7. Particularly, a gas is fast redissolved in the ink in the circulation state compared to the circulation stop state. Additionally, in a case where the liquid ejection head that circulates the ink at the ejection opening is used, a gas is also redissolved in the ink at the ejection opening portion and thus the dissolved oxygen amount of the entire ink further increases due to the circulation.

As described above, the ink does not easily flow toward the liquid ejection head 3 during the deaeration operation of the deaeration tank 1023. For this reason, in a case where a printing start signal is input to the controller during the deaeration operation, the deaeration operation is first stopped and the deaeration tank 1023 is opened to the atmosphere. Then, the printing operation needs to be performed after the start of the ink circulation operation. For this reason, there is a time loss until the printing operation is started after the printing start signal is input to the controller. In this way, a device using the deaeration tank 1023 can be provided at low cost, but this device has concern that the gas is easily redissolved in the ink and the printing operation is not directly performed during the deaeration operation. However, in the embodiment, the above-described concern can be solved by the following configuration.

Generally, in the liquid ejection apparatus, a recovery operation such as a suction recovery operation is performed after an ink charging operation is performed on the liquid ejection apparatus which is not used from a recent delivery date or after a long period of time elapses from the use state. In the embodiment, in an initial state immediately after the recovery operation, the deaerated ink is circulated for a relatively long time to remove the bubbles inside the circulation passage including the passage formed in the liquid ejection head 3. In this way, the dissolved oxygen amount of the ink is largely decreased.

In this way, since the dissolved oxygen amount of the ink is largely decreased immediately after the recovery operation, it is possible to largely delay the time until the bubble having a diameter disturbing the ejection or the flow of the ink is generated even when the dissolved oxygen amount of the ink increases due to the redissolving of the gas in the ink. In the embodiment, since the bubble removing operation is performed by the circulation of the deaerated ink at the first day immediately after the recovery operation, there is no need to frequently perform the deaeration operation on the deaeration tank 1023 until the next recovery operation is started. For this reason, in a case where the printing start signal is input, the circulation operation and the printing operation of the ink are performed in a short time. Accordingly, it is possible to suppress a time loss until the printing operation starts after the input of the printing start signal.

Further, in the liquid ejection head in which the ink flows in the passage inside the liquid ejection head 3, the evaporation of moisture from the ejection opening is promoted. For this reason, since the ink is thickened, the ink ejection characteristics are degraded and the ejection failure occurs. As a result, image quality is also easily degraded. However, in the embodiment, since the circulation of the ink for removing the bubble and the gas is performed only after the recovery operation, the circulation of the ink during the printing operation can be stopped until the next recovery operation. For this reason, it is possible to largely reduce the thickening of the ink caused by the circulation of the ink. In this way, the embodiment is effective for the configuration of circulating the ink inside the liquid ejection head and the configuration of using the deaeration tank.

Figure 8:
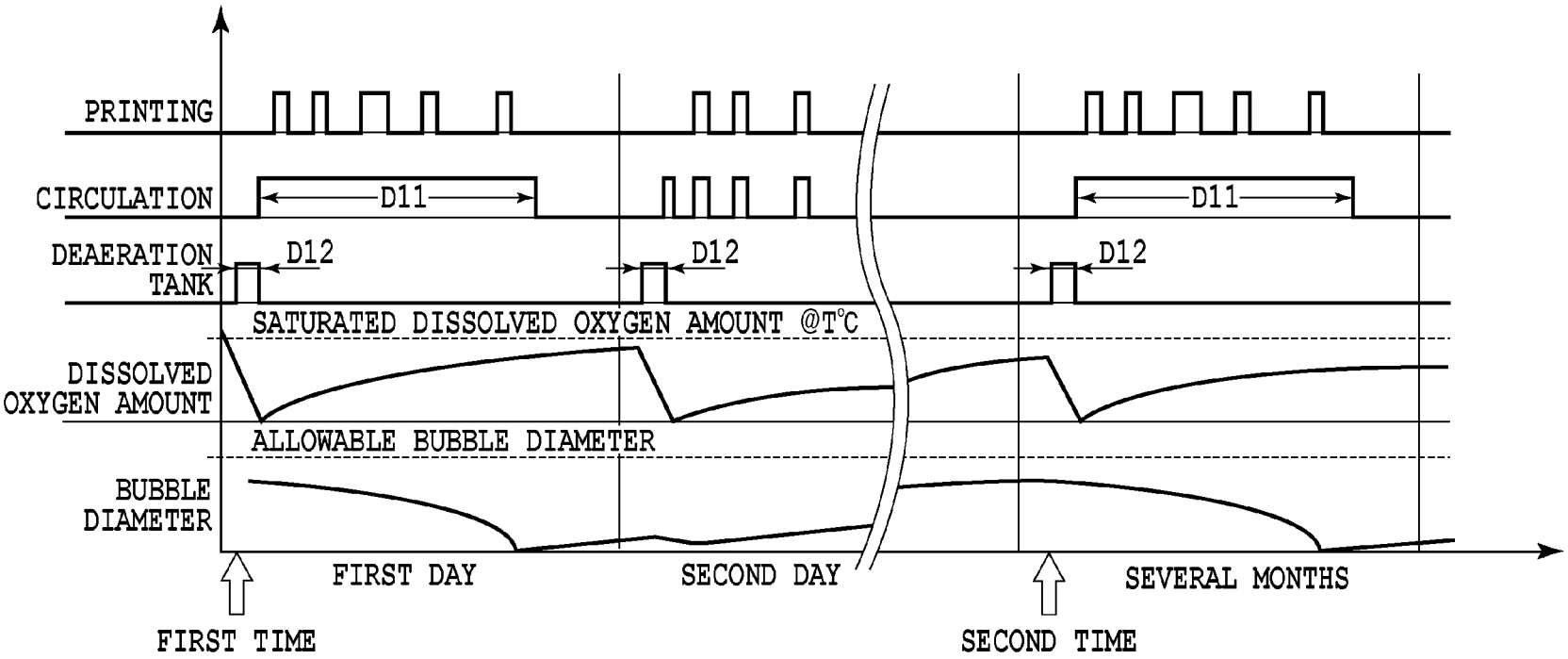
FIG. 8 is an explanatory diagram illustrating a relation between a bubble diameter inside a passage and an operation timing of each of components of the second embodiment.

FIG. 8 is an explanatory diagram illustrating a relation between a bubble diameter inside the passage and the operation timing of each of components of the embodiment. In a case where the printing apparatus 1000 is not used or a case immediately after the liquid ejection head 3 is attached or replaced, the initial ink charging operation is performed and the recovery operation is performed. After the recovery operation, the deaeration operation is performed on the ink inside the deaeration tank 1023 as described above. Then, after the deaeration operation ends, the ink circulation operation is performed for a period D11. Since the ejection opening of the liquid ejection head 3 is covered by the cap 114 during the ink circulation operation, the thickening of the ink caused by the evaporation of the solvent of the ink from the ejection opening is suppressed.

In a case where the printing start signal is input, the ink circulation operation is continuously performed and the printing operation is started after the cap is separated from the ejection opening. Due to the circulation of the ink, the dissolved oxygen amount of the ink gradually increases. The dissolved oxygen amount of the ink and the increased amount thereof can be estimated in advance from the time until the circulation of the ink starts from a time point in which the ink deaeration operation ends, the ink circulation time, the ink temperature, and the ink charge amount in the tank. In the embodiment, the deaeration operation which is performed once inside the deaeration tank 1023 immediately after the recovery operation and the deaerated ink circulation period are determined on the basis of an increase in estimation value of the dissolved oxygen amount. That is, the dissolved oxygen amount of the ink which increases until the next recovery operation is suppressed to be smaller than the saturated dissolved oxygen amount. Further, the ink deaeration operation may be performed for a relatively short period D12 to a degree in which the dissolved oxygen amount of the ink is not saturated at the maximal use temperature (T° C.) of the liquid ejection head after the deaerated ink circulation operation ends immediately after the recovery operation.

After a predetermined period elapses from the deaeration operation and the circulation operation which are performed firstly after the first recovery operation, a second recovery operation is performed. Subsequently, similarly to the first time, the recovery operation, the deaeration operation, and the circulation operation are performed secondly. Further, the predetermined period is about several months although the bubble grows differently in accordance with the ink type, the redissolving speed, the supply passage structure, and the use environment.

The time of the deaerated ink circulation operation which is performed after the recovery operation is determined in accordance with the amount of the bubble remaining after the recovery operation, the maximal diameter (the allowable bubble diameter) of the bubble which does not disturb the flow of the ink in the circulation passage, and the amount of the dissolved oxygen inside the ink decreased by the deaeration operation. In the embodiment, when the deaerated ink having the dissolved oxygen amount of about 5.2 ppm is generated by the deaeration tank 1023 and the deaerated ink is circulated in the circulation passage for about three hours, the bubble having a diameter of about 0.6 mm can be removed.

Figure 9:
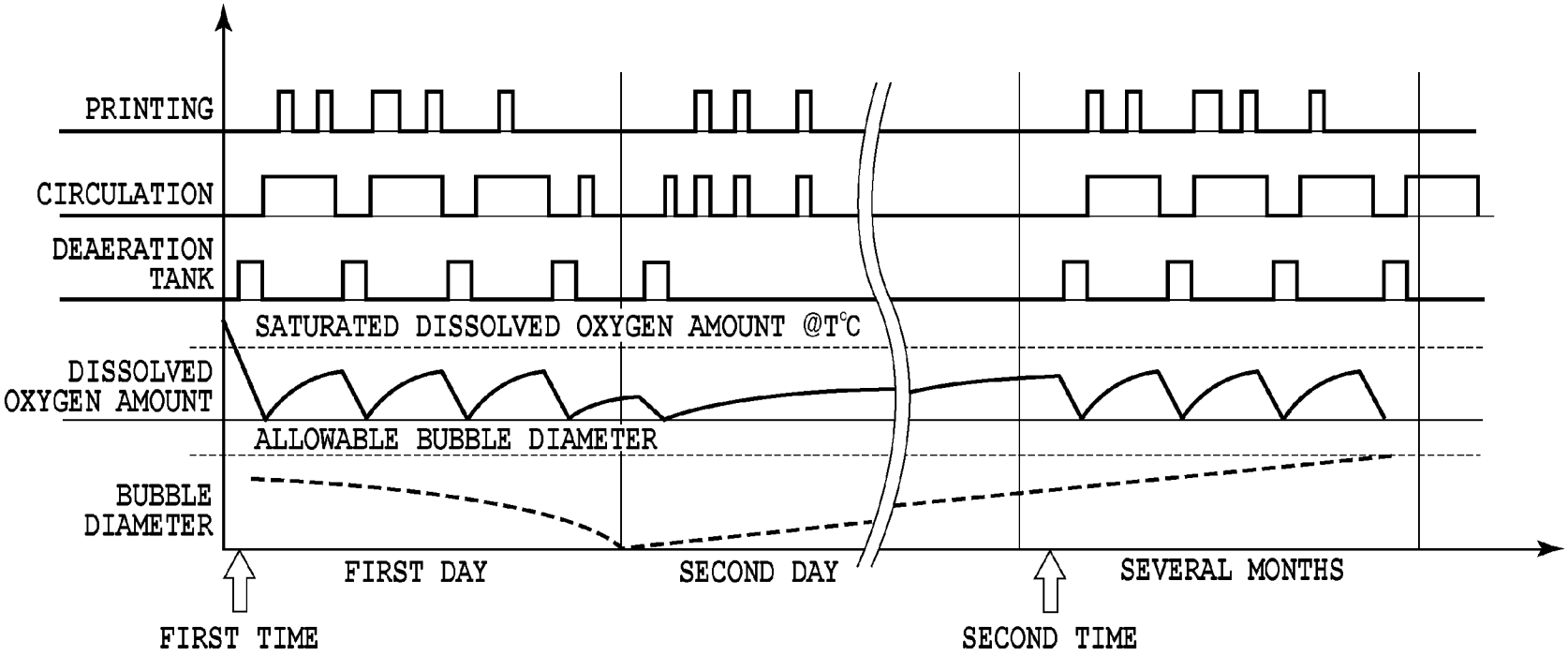
FIG. 9 is an explanatory diagram illustrating a dissolved oxygen amount and a bubble diameter of ink existing inside a circulation passage of a modified example of the second embodiment.

Next, a modified example of the second embodiment will be described with reference to FIGS. 9 and 10. FIG. 9 is an explanatory diagram illustrating a dissolved oxygen amount and a diameter of the bubble existing in the ink inside the circulation passage. As illustrated in FIG. 9, in the modified example, the controller 3000 serving as the control unit performs the ink circulation operation and the deaeration operation using the deaeration tank at a timing different from the operation timing illustrated in FIG. 8. The operation method of the modified example is particularly effective in a case where the capacity of the ink in the deaeration tank 1023 and the circulation passage is small. That is, in a case where the capacity of the ink in the deaeration tank 1023 and the circulation passage is small, the gas redissolving speed in the ink circulation state becomes fast. For that reason, a series of operations are repeated in such a manner that the ink is deaerated in the deaeration tank and the ink circulation operation is started again before the dissolved oxygen amount of the ink reaches the saturated dissolved oxygen amount due to the circulation of the ink. In a case where the deaeration operation and the circulation operation are repeatedly performed almost all day long, the accumulated time (the flow amount) involving with the flow of the deaerated ink can be regarded as the circulation time (the flow amount) for removing the bubble. Thus, when the deaeration operation and the circulation operation are repeatedly performed at the first day after the recovery operation, it is possible to sufficiently remove the bubbles remaining inside the circulation passage after the recovery operation.

Figure 10:
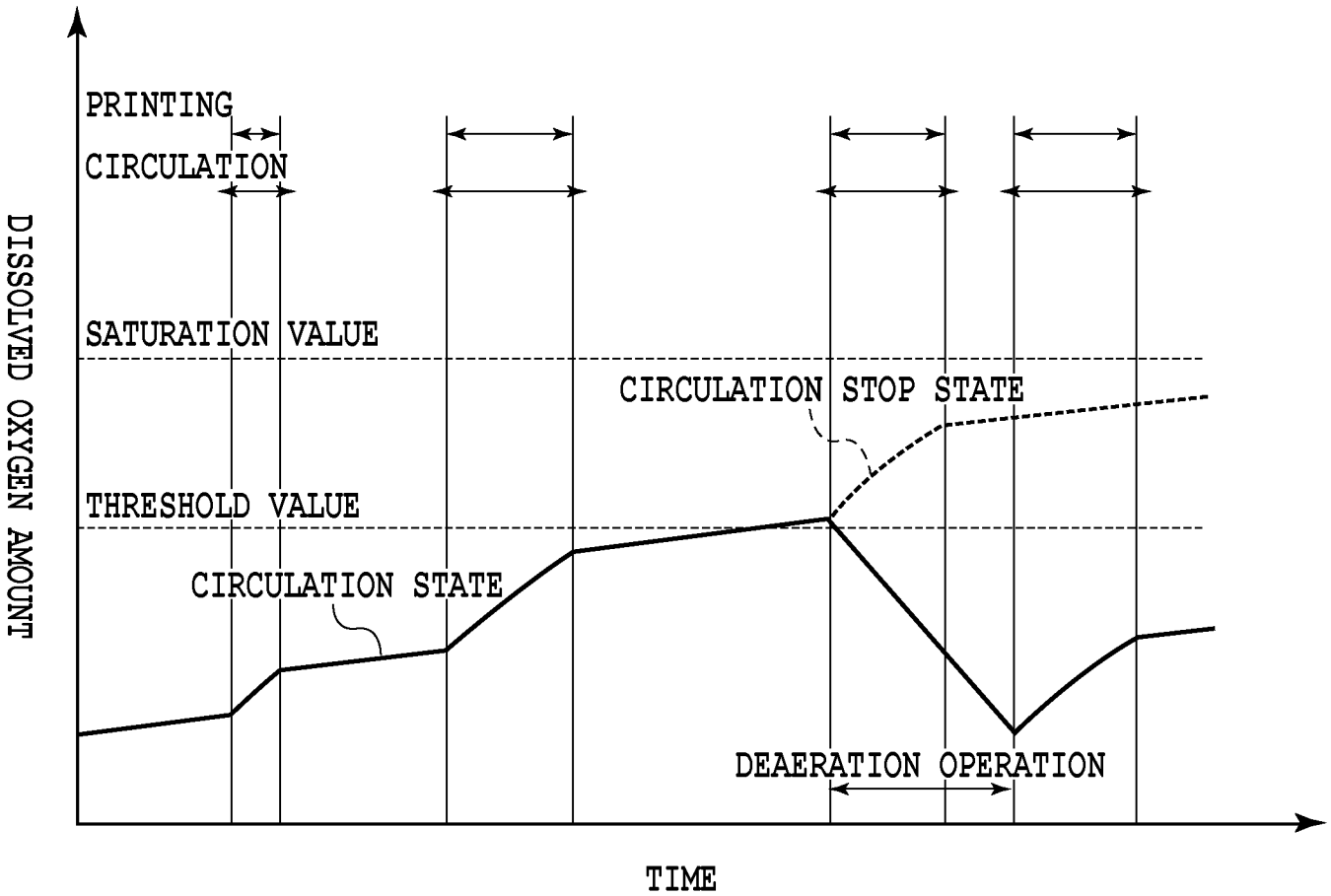
FIG. 10 is a diagram illustrating a dissolved oxygen amount of ink having been subjected to an initial bubble removing operation of the modified example of the second embodiment.

FIG. 10 is a diagram illustrating a deaeration state of the ink having been subjected to the initial bubble removing operation (the bubble removing operation performed at the first day after the recovery operation) of the modified example, that is, a deaeration state (a dissolved oxygen amount) inside the ink since the second day after the recovery operation. A period until the printing operation starts after the deaeration operation is performed by the deaeration tank 1023 since the second day is in the non-circulation state in which the circulation of the ink is temporarily stopped. In the non-circulation state, the dissolved oxygen amount of the ink inside the circulation passage gently increases at a small increase rate.

The controller 3000 having received a printing start signal first starts the circulation of the ink and then starts the printing operation. When the printing operation starts, an increase rate of the dissolved oxygen amount inside the ink largely increases compared to the non-circulation state and thus the dissolved oxygen amount inside the circulation passage abruptly increases. After the printing operation ends, the ink is not circulated. For this reason, an increase rate of the dissolved oxygen amount of the ink decreases. By repeating such operations, the dissolved oxygen amount inside the ink increases. Additionally, since the printing operation is performed while the ink is circulated, it is desirable that the ink circulation operation is performed at a timing earlier than the printing operation when the printing start signal is input to the controller and the circulation of the ink is stopped after the printing operation ends.

In the modified example, in a case where a predetermined threshold value is set for the dissolved oxygen amount inside the ink and the printing start signal is input to the controller while the dissolved oxygen amount exceeds the threshold value, the controller 3000 determines whether the dissolved oxygen amount (the estimation value) inside the ink exceeds the threshold value due to the printing operation. Then, when it is determined that the dissolved oxygen amount inside the ink exceeds the saturated dissolved oxygen amount due to the printing operation, the deaeration of the ink is performed first. Accordingly, the deaeration operation is immediately performed by the deaeration tank 1023. Further, when it is determined that the dissolved oxygen amount of the ink is equal to or smaller than the threshold value even when the printing operation is performed, the controller 3000 performs the printing operation first. Additionally, the dissolved oxygen amount inside the ink is estimated as illustrated in FIG. 10 from a history of the printing operation.

In this way, when the dissolved oxygen amount inside the ink is estimated and the threshold value of the dissolved oxygen amount is set, the deaeration operation of the deaeration tank 1023 can be performed on the basis of a comparison between the estimation value and the threshold value. Accordingly, it is possible to avoid a standby state due to the deaeration operation when the controller receives the printing start signal. Further, since the deaeration operation is performed in accordance with the use state, a satisfactory deaeration state for the printing operation can be maintained efficiently. Additionally, the threshold value is set to a value in which the dissolved oxygen amount illustrated in FIG. 7 does not change to be saturated in a maximal continuous printing time. Alternatively, a printing time may be obtained from an image signal without setting the threshold value. Then, it is determined whether the dissolved oxygen amount inside the ink exceeds an allowable value such as a saturated dissolved oxygen amount within the printing time. Next, it is determined whether to perform the printing operation on the basis of the determination result.

Third Embodiment

Next, a third embodiment of the invention will be described. A liquid ejection apparatus of the third embodiment is configured to cause the liquid inside an ejection opening formed in a liquid ejection head to flow. Hereinafter, the liquid ejection apparatus of the embodiment will be described in detail below.

(Description of Inkjet Printing Apparatus)

Figure 11:
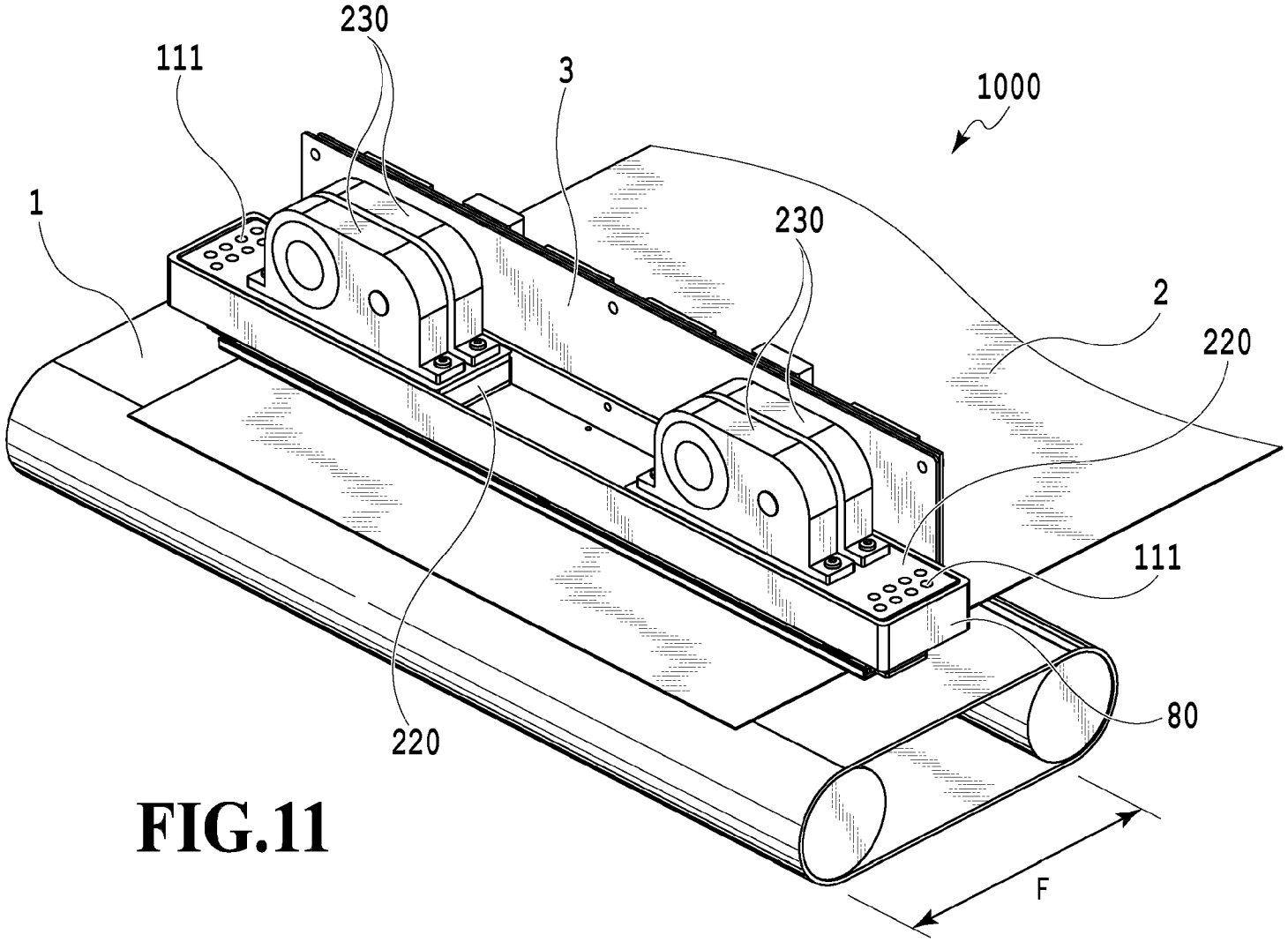
FIG. 11 is a perspective view illustrating a schematic configuration of the liquid ejection apparatus.

FIG. 11 is a diagram illustrating a schematic configuration of a liquid ejection apparatus that ejects a liquid in the invention and particularly an inkjet printing apparatus (hereinafter, also referred to as a printing apparatus) 1000 that prints an image by ejecting ink. The printing apparatus 1000 includes a conveying unit 1 which conveys a print medium 2 and a line type (page wide type) liquid ejection head 3 which is disposed to be substantially orthogonal to the conveying direction of the print medium 2. Then, the printing apparatus 1000 is a line type printing apparatus which continuously prints an image at one pass by ejecting ink onto the relative moving print mediums 2 while continuously or intermittently conveying the print mediums 2. The liquid ejection head 3 includes a negative pressure control unit 230 which controls a pressure (a negative pressure) inside a circulation path, a liquid supply unit 220 which communicates with the negative pressure control unit 230 so that a fluid can flow therebetween, a liquid connection portion 111 which serves as an ink supply opening and an ink discharge opening for supplying to the liquid supply unit 220, and a casing 80. The print medium 2 is not limited to a cut sheet and may be also a continuous roll medium.

The liquid ejection head 3 can print a full color image by inks of cyan C, magenta M, yellow Y, and black K and is fluidly connected to a liquid supply member which serve as a supply path supplying a liquid to the liquid ejection head 3, a main tank, and a buffer tank (see FIG. 12 to be described later). Further, the control unit which supplies power and transmits an ejection control signal to the liquid ejection head 3 is electrically connected to the liquid ejection head 3. The liquid path and the electric signal path in the liquid ejection head 3 will be described later.

The printing apparatus 1000 is an inkjet printing apparatus that circulates a liquid such as ink between a tank to be described later and the liquid ejection head 3. The circulation configuration includes a first circulation configuration in which the liquid is circulated by the activation of two circulation pumps (for high and low pressures) at the downstream side of the liquid ejection head 3 and a second circulation configuration in which the liquid is circulated by the activation of two circulation pumps (for high and low pressures) at the upstream side of the liquid ejection head 3. Hereinafter, the first circulation configuration and the second circulation configuration of the circulation will be described.

(Description of First Circulation Configuration)

Figure 12:
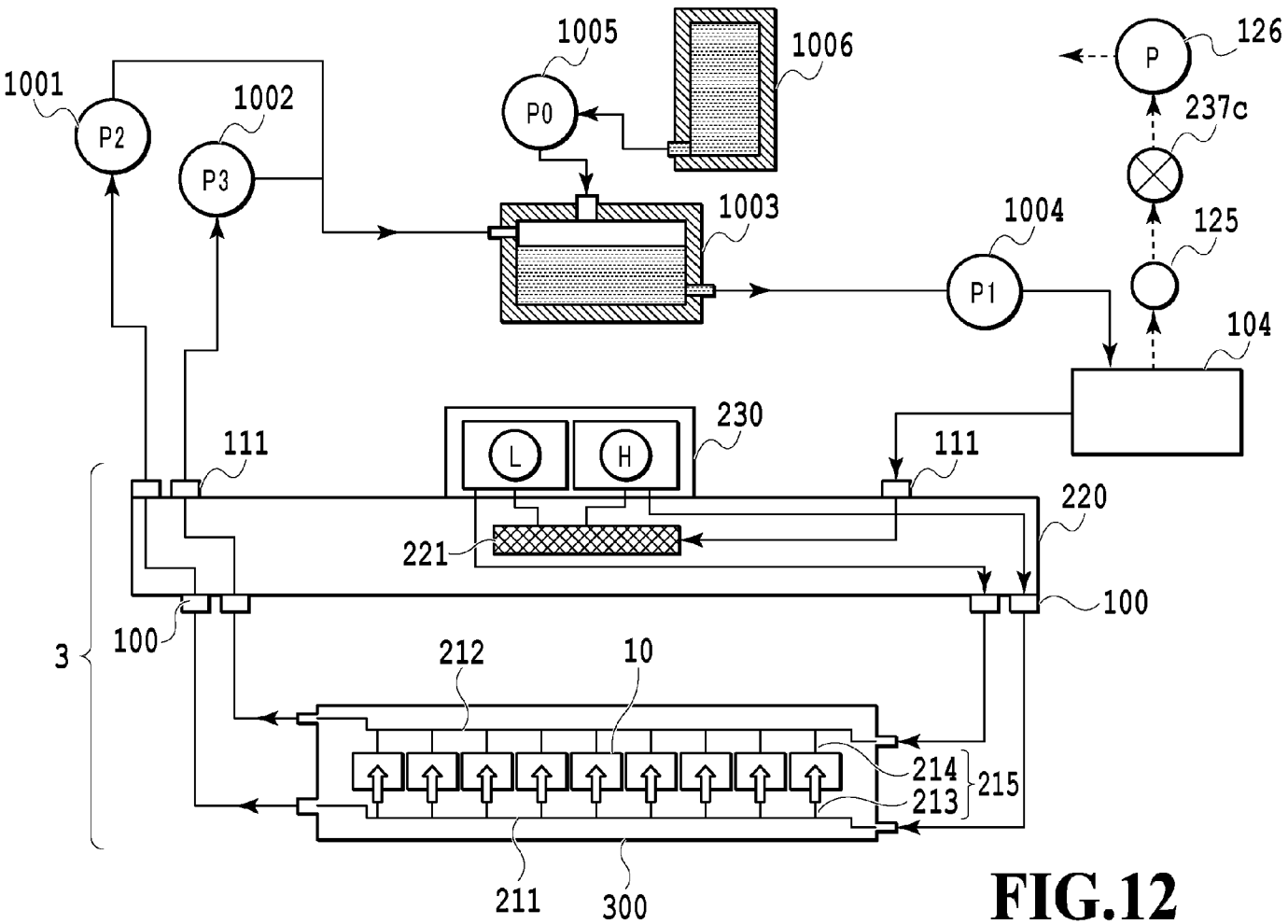
FIG. 12 is a schematic diagram illustrating a first circulation mode of a circulation path applied to a printing apparatus of the embodiment.

FIG. 12 is a schematic diagram illustrating the first circulation configuration in the circulation path applied to the printing apparatus 1000 of the present embodiment. The liquid ejection head 3 is fluidly connected to a first circulation pump (the high pressure side) 1001, a first circulation pump (the low pressure side) 1002, and a buffer tank 1003. Further, in FIG. 12, in order to simplify a description, a path through which ink of one color of cyan C, magenta M, yellow Y, and black K flows is illustrated. However, in fact, four colors of circulation paths are provided in the liquid ejection head 3 and the printing apparatus body.

In the circulation configuration, ink inside a main tank 1006 is supplied into the buffer tank 1003 by a replenishing pump 1005 and then is supplied to the liquid supply unit 220 of the liquid ejection head 3 through the liquid connection portion 111 by a second circulation pump 1004. Subsequently, the ink which is adjusted to two different negative pressures (high and low pressures) by the negative pressure control unit 230 connected to the liquid supply unit 220 is circulated while being divided into two passages having the high and low pressures. The ink inside the liquid ejection head 3 is circulated in the liquid ejection head by the actions of the first circulation pump (the high pressure side) 1001 and the first circulation pump (the low pressure side) 1002 at the downstream side of the liquid ejection head 3, is discharged from the liquid ejection head 3 through the liquid connection portion 111, and is returned to the buffer tank 1003.

The buffer tank 1003 which is a sub-tank includes an atmosphere communication opening (not illustrated) which is connected to the main tank 1006 to communicate the inside of the tank with the outside and thus can discharge bubbles inside the ink to the outside. The replenishing pump 1005 is provided between the buffer tank 1003 and the main tank 1006. The replenishing pump 1005 delivers the ink from the main tank 1006 to the buffer tank 1003 after the ink is consumed by the ejection (the discharge) of the ink from the ejection opening of the liquid ejection head 3 in the printing operation and the suction collection operation.

Two first circulation pumps 1001 and 1002 draw the liquid from the liquid connection portion 111 of the liquid ejection head 3 so that the liquid flows to the buffer tank 1003. As the first circulation pump, a displacement pump having quantitative liquid delivery ability is desirable. Specifically, a tube pump, a gear pump, a diaphragm pump, and a syringe pump can be exemplified. However, for example, a general constant flow valve or a general relief valve may be disposed at an outlet of a pump to ensure a predetermined flow rate. When the liquid ejection head 3 is driven, the first circulation pump (the high pressure side) 1001 and the first circulation pump (the low pressure side) 1002 are operated so that the ink flows at a predetermined flow rate through a common supply passage 211 and a common collection passage 212. Since the ink flows in this way, the temperature of the liquid ejection head 3 during a printing operation is kept at an optimal temperature. The predetermined flow rate when the liquid ejection head 3 is driven is desirably set to be equal to or higher than a flow rate at which a difference in temperature among the print element boards 10 inside the liquid ejection head 3 does not influence printing quality.

Above all, when a too high flow rate is set, a difference in negative pressure among the print element boards 10 increases due to the influence of pressure loss of the passage inside a liquid ejection unit 300 and thus unevenness in density of an image is caused. For that reason, it is desirable to set the flow rate in consideration of a difference in temperature and a difference in negative pressure among the print element boards 10.

The negative pressure control unit 230 is provided in a path between the second circulation pump 1004 and the liquid ejection unit 300. The negative pressure control unit 230 is operated to keep a pressure at the downstream side (that is, a pressure near the liquid ejection unit 300) of the negative pressure control unit 230 at a predetermined pressure even when the flow rate of the ink changes in the circulation system due to a difference in ejection amount per unit area. As two negative pressure control mechanisms constituting the negative pressure control unit 230, any mechanism may be used as long as a pressure at the downstream side of the negative pressure control unit 230 can be controlled within a predetermined range having a desired set pressure as its center.

As an example, a mechanism such as a so-called "pressure reduction regulator" can be employed. In the circulation passage of the embodiment, the upstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, a degree of freedom in layout of the buffer tank 1003 of the printing apparatus 1000 can be widened.

As the second circulation pump 1004, a turbo pump or a displacement pump can be used as long as a predetermined head pressure or more can be exhibited in the range of the ink circulation flow rate used when the liquid ejection head 3 is driven. Specifically, a diaphragm pump can be used. Further, for example, a water head tank disposed to have a certain water head difference with respect to the negative pressure control unit 230 can be also used instead of the second circulation pump 1004.

As illustrated in FIG. 12, the negative pressure control unit 230 includes two negative pressure adjustment mechanisms respectively having different control pressures. Among two negative pressure adjustment mechanisms, a relatively high pressure side (indicated by "H" in FIG. 12) and a relatively low pressure side (indicated by "L" in FIG. 12) are respectively connected to the common supply passage 211 and the common collection passage 212 inside the liquid ejection unit 300 through the liquid supply unit 220.

The liquid ejection unit 300 is provided with the common supply passage 211, the common collection passage 212, and an individual passage 215 (an individual supply passage 213 and an individual collection passage 214) as an ejection communicating passage communicating with the ejection port of the print element board. The negative pressure control mechanism H is connected to the common supply passage 211, the negative pressure control mechanism L is connected to the common collection passage 212, and a differential pressure is formed between two common passages. Then, since the individual passage 215 communicates with the common supply passage 211 and the common collection passage 212, a flow (a flow indicated by an arrow direction of FIG. 12) is generated in which a part of the liquid flows from the common supply passage 211 to the common collection passage 212 through the passage formed inside the print element board 10.

In this way, the liquid ejection unit 300 has a flow in which a part of the liquid passes through the print element boards 10 while the liquid flows to pass through the common supply passage 211 and the common collection passage 212. For this reason, heat generated by the print element boards 10 can be discharged to the outside of the print element board 10 by the ink flowing through the common supply passage 211 and the common collection passage 212. With such a configuration, the flow of the ink can be generated even in the pressure chamber or the ejection opening not ejecting the liquid when an image is printed by the liquid ejection head 3. Accordingly, the thickening of the ink can be suppressed in such a manner that the viscosity of the ink thickened inside the ejection opening is decreased. Further, the thickened ink or the foreign material in the ink can be discharged toward the common collection passage 212. For this reason, the liquid ejection head 3 of the present embodiment can print a high-quality image at a high speed.

Further, in a case where a charging operation and a recovery operation are performed on the liquid ejection head in a first circulation mode, the ink is first charged into a common supply passage 211, a common collection passage 212, and a common passage connected to these passages and bubbles are discharged. Subsequently, the ink is charged into a print element board 10, an individual supply passage 213, and an individual collection passage 214. Thus, it is possible to suppress bubbles from remaining inside the liquid ejection head 3. Specifically, a charging operation and a recovery operation of the liquid ejection head 3 are performed by the following operation. First, all of the second circulation pump 1004 and the first circulation pumps 1001 and 1002 are driven and a valve inside the negative pressure control unit 230 is opened. By the driving, the ink flows from the second circulation pump 1004 to the first circulation pumps 1001 and 1002 through the negative pressure control unit 230, a liquid supply unit 220, a liquid ejection unit 300, and the liquid supply unit 220 and is collected by the buffer tank 1003. By the flow of the ink, the bubbles existing inside the common supply passage 211, the common collection passage 212, and the common passage of the liquid ejection head 3 are discharged to the outside of the liquid ejection head 3. Subsequently, the driving of the first circulation pumps 1001 and 1002 is stopped and a valve (not illustrated) disposed near the buffer tank 1003 at the downstream side of the liquid ejection head 3 is closed. Then, a pressurization operation is performed only by the driving of the second circulation pump 1004. Thus, a charging operation and a recovery operation are performed on the individual supply passage 213, the individual collection passage 214, and the passage inside the print element board 10 provided in the liquid ejection head 3.

(Description of Second Circulation Configuration)

Figure 13:
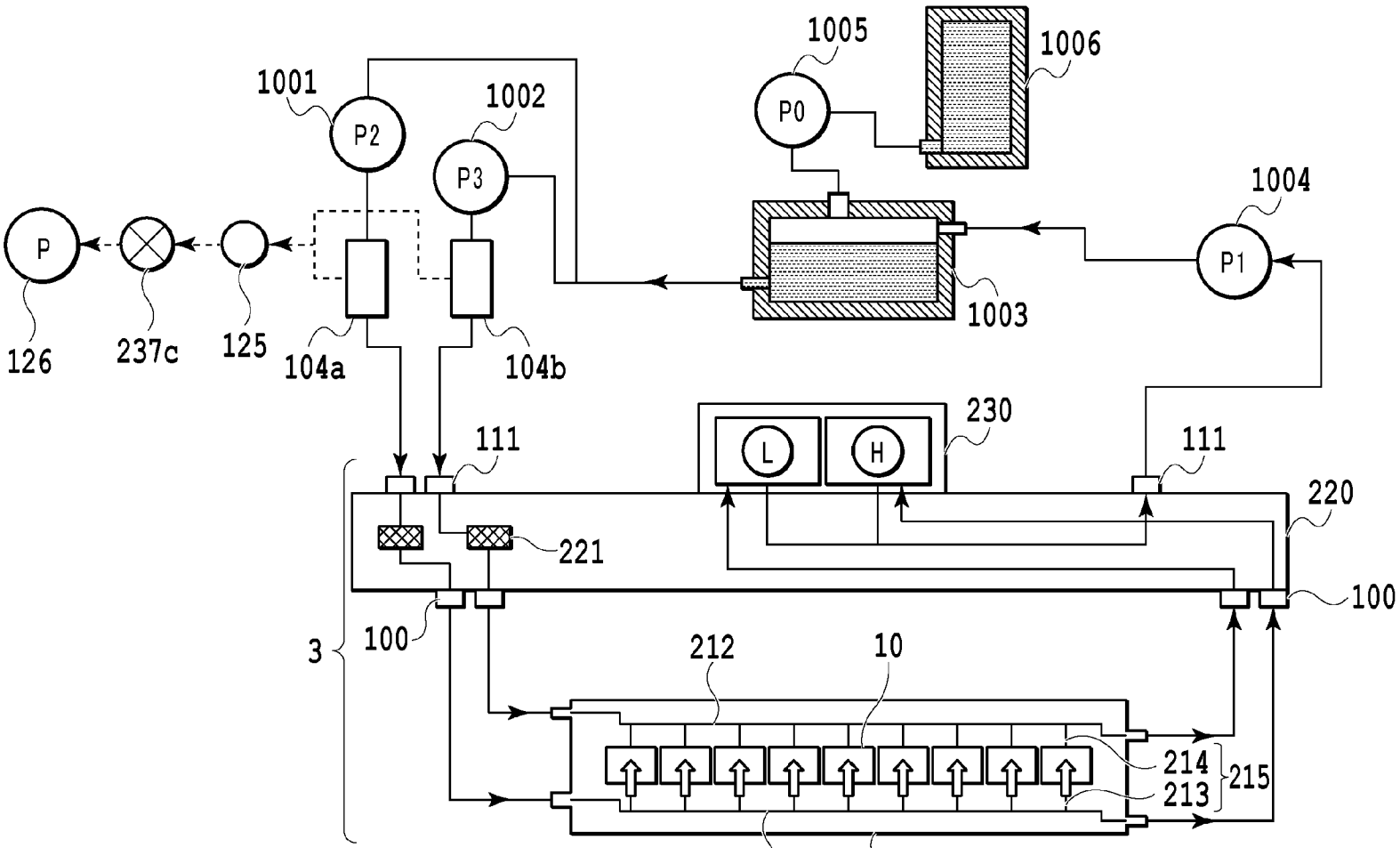
FIG. 13 is a schematic diagram illustrating a second circulation mode of a circulation path applied to the printing apparatus of the embodiment.

FIG. 13 is a schematic diagram illustrating the second circulation configuration which is a circulation configuration different from the first circulation configuration in the circulation path applied to the printing apparatus of the embodiment. A main difference from the first circulation configuration is that two negative pressure control mechanisms constituting the negative pressure control unit 230 both control a pressure at the upstream side of the negative pressure control unit 230 within a predetermined range from a desired set pressure. Further, another difference from the first circulation configuration is that the second circulation pump 1004 serves as a negative pressure source which reduces a pressure at the downstream side of the negative pressure control unit 230. Further, still another difference is that the first circulation pump (the high pressure side) 1001 and the first circulation pump (the low pressure side) 1002 are disposed at the upstream side of the liquid ejection head 3 and the negative pressure control unit 230 is disposed at the downstream side of the liquid ejection head 3.

In the second circulation configuration, as shown in FIG. 3, the ink inside the main tank 1006 is supplied to the buffer tank 1003 by the replenishing pump 1005. Subsequently, the ink is divided into two passages and is circulated in two passages at the high pressure side and the low pressure side by the action of the negative pressure control unit 230 provided in the liquid ejection head 3. The ink which is divided into two passages at the high pressure side and the low pressure side is supplied to the liquid ejection head 3 through the liquid connection portion 111 by the action of the first circulation pump (the high pressure side) 1001 and the first circulation pump (the low pressure side) 1002. Subsequently, the ink circulated inside the liquid ejection head by the action of the first circulation pump (the high pressure side) 1001 and the first circulation pump (the low pressure side) 1002 is discharged from the liquid ejection head 3 through the liquid connection portion 111 by the negative pressure control unit 230. The discharged ink is returned to the buffer tank 1003 by the second circulation pump 1004.

In the second circulation configuration, the negative pressure control unit 230 stabilizes a change in pressure at the upstream side (that is, the liquid ejection unit 300) of the negative pressure control unit 230 within a predetermined range from a predetermined pressure even when a change in flow rate is caused by a change in ejection amount per unit area. In the circulation passage of the embodiment, the downstream side of the negative pressure control unit 230 is pressurized by the second circulation pump 1004 through the liquid supply unit 220. With such a configuration, since an influence of a water head pressure of the buffer tank 1003 with respect to the liquid ejection head 3 can be suppressed, the layout of the buffer tank 1003 in the printing apparatus 1000 can have many options. Instead of the second circulation pump 1004, for example, a water head tank disposed to have a predetermined water head difference with respect to the negative pressure control unit 230 can be also used.

Similarly to the first circulation configuration, in the second circulation configuration, the negative pressure control unit 230 includes two negative pressure control mechanisms respectively having different control pressures. Among two negative pressure adjustment mechanisms, a high pressure side (indicated by "H" in FIG. 13) and a low pressure side (indicated by "L" in FIG. 13) are respectively connected to the common supply passage 211 or the common collection passage 212 inside the liquid ejection unit 300 through the liquid supply unit 220. When the pressure of the common supply passage 211 is set to be higher than the pressure of the common collection passage 212 by two negative pressure adjustment mechanisms, a flow of the liquid is formed from the common supply passage 211 to the common collection passage 212 through the individual passage 215 and the passages formed inside the print element boards 10.

In such a second circulation configuration, the same liquid flow as that of the first circulation configuration can be obtained inside the liquid ejection unit 300, but has two advantages different from those of the first circulation configuration. As a first advantage, in the second circulation configuration, since the negative pressure control unit 230 is disposed at the downstream side of the liquid ejection head 3, there is low concern that a foreign material or trash produced from the negative pressure control unit 230 flows into the liquid ejection head 3. As a second advantage, in the second circulation configuration, a maximal value of the flow rate necessary for the liquid from the buffer tank 1003 to the liquid ejection head 3 is smaller than that of the first circulation configuration. The reason is as below.

In the case of the circulation in the print standby state, the sum of the flow rates of the common supply passage 211 and the common collection passage 212 is set to a flow rate A. The value of the flow rate A is defined as a minimal flow rate necessary to adjust the temperature of the liquid ejection head 3 in the print standby state so that a difference in temperature inside the liquid ejection unit 300 falls within a desired range. Further, the ejection flow rate obtained when the ink is ejected from all ejection openings of the liquid ejection unit 300 (the full ejection state) is defined as a flow rate F (the ejection amount per each ejection opening×the ejection frequency per unit time×the number of the ejection openings).

Figure 14:
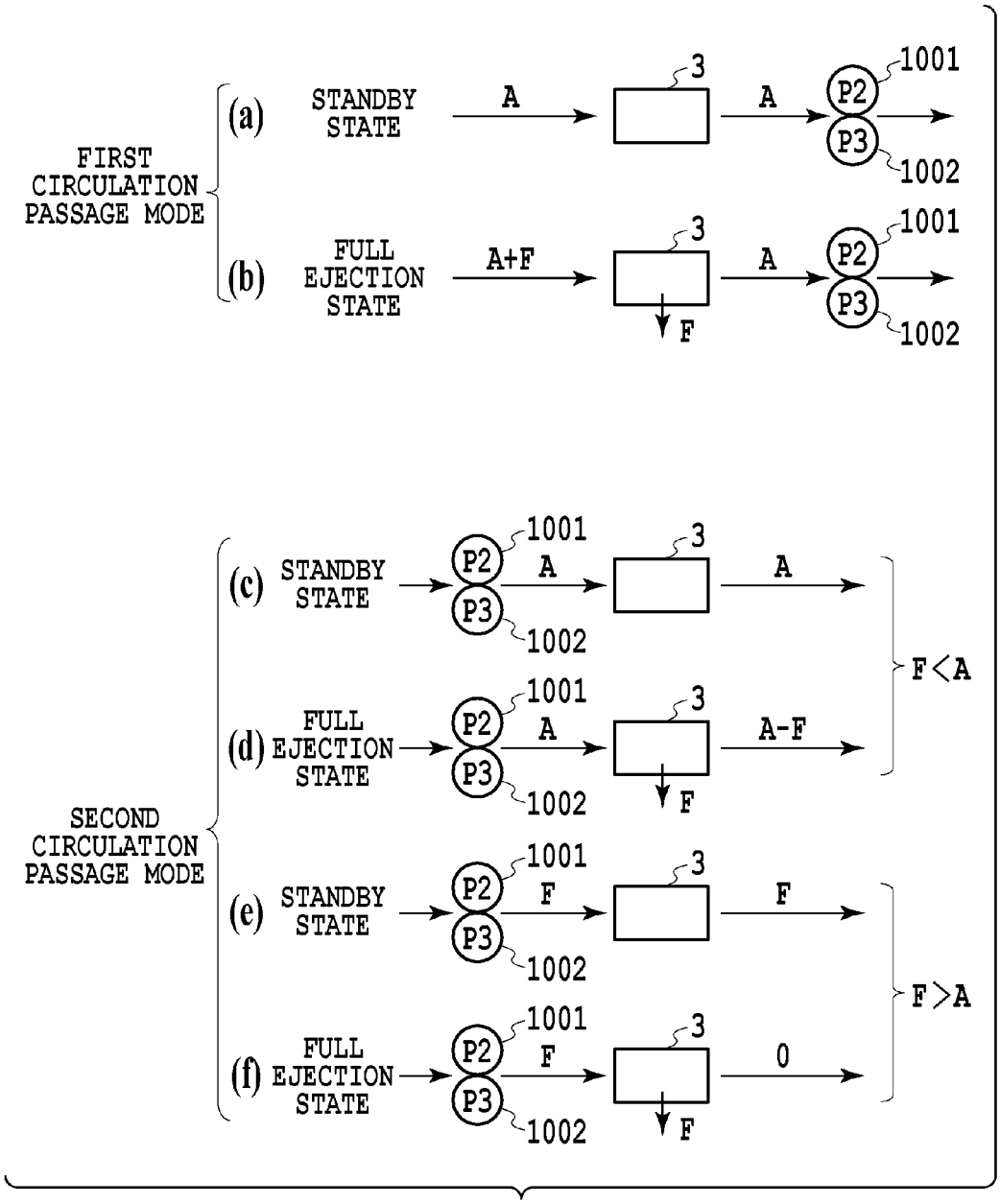
FIG. 14 is a schematic diagram illustrating a difference in ink inflow amount with respect to a liquid ejection head in the first circulation mode and the second circulation mode.

FIG. 14 is a schematic diagram illustrating a difference in ink inflow amount to the liquid ejection head between the first circulation configuration and the second circulation configuration. Part (a) of FIG. 14 illustrates the standby state in the first circulation configuration and part (b) of FIG. 14 illustrates the full ejection state in the first circulation configuration. Parts (c) to (f) of FIG. 14 illustrate the second circulation passage. Here, parts (c) and (d) of FIG. 14 illustrate a case where the flow rate F is lower than the flow rate A and parts (e) and (f) of FIG. 14 illustrate a case where the flow rate F is higher than the flow rate A. In this way, the flow rates in the standby state and the full ejection state are illustrated.

In the case of the first circulation configuration (part (a) and (b) of FIG. 14) in which the first circulation pump 1001 and the first circulation pump 1002 each having a quantitative liquid delivery ability are disposed at the downstream side of the liquid ejection head 3, the total flow rate of the first circulation pump 1001 and the first circulation pump 1002 becomes the flow rate A. By the flow rate A, the temperature inside the liquid ejection unit 300 in the standby state can be managed. Then, in the case of the full ejection state of the liquid ejection head 3, the total flow rate of the first circulation pump 1001 and the first circulation pump 1002 becomes the flow rate A. However, a maximal flow rate of the liquid supplied to the liquid ejection head 3 is obtained such that the flow rate F consumed by the full ejection is added to the flow rate A of the total flow rate by the action of the negative pressure generated by the ejection of the liquid ejection head 3. Thus, a maximal value of the supply amount to the liquid ejection head 3 satisfies a relation of the flow rate A+the flow rate F since the flow rate F is added to the flow rate A (part (b) of FIG. 14).

Meanwhile, in the case of the second circulation configuration (parts (c) to (f) of FIG. 14) in which the first circulation pump 1001 and the first circulation pump 1002 are disposed at the upstream side of the liquid ejection head 3, the supply amount to the liquid ejection head 3 necessary for the print standby state becomes the flow rate A similarly to the first circulation configuration. Thus, when the flow rate A is higher than the flow rate F (parts (c) and (d) of FIG. 14) in the second circulation configuration in which the first circulation pump 1001 and the first circulation pump 1002 are disposed at the upstream side of the liquid ejection head 3, the supply amount to the liquid ejection head 3 sufficiently becomes the flow rate A even in the full ejection state. At that time, the discharge flow rate of the liquid ejection head 3 satisfies a relation of the flow rate A−the flow rate F (part (d) of FIG. 14).

However, when the flow rate F is higher than the flow rate A (parts (e) and (f) of FIG. 14), the flow rate becomes insufficient when the flow rate of the liquid supplied to the liquid ejection head 3 becomes the flow rate A in the full ejection state. For that reason, when the flow rate F is higher than the flow rate A, the supply amount to the liquid ejection head 3 needs to be set to the flow rate F. At that time, since the flow rate F is consumed by the liquid ejection head 3 in the full ejection state, the flow rate of the liquid discharged from the liquid ejection head 3 becomes almost zero (part (f) of FIG. 14). In addition, if the liquid is not ejected in the full ejection state when the flow rate F is higher than the flow rate A, the liquid which is attracted by the amount consumed by the ejection of the flow rate F is discharged from the liquid ejection head 3.

In this way, in the case of the second circulation configuration, the total value of the flow rates set for the first circulation pump 1001 and the first circulation pump 1002, that is, the maximal value of the necessary supply flow rate becomes a large value among the flow rate A and the flow rate F. For this reason, as long as the liquid ejection unit 300 having the same configuration is used, the maximal value (the flow rate A or the flow rate F) of the supply amount necessary for the second circulation configuration becomes smaller than the maximal value (the flow rate A+the flow rate F) of the supply flow rate necessary for the first circulation configuration.

For that reason, in the case of the second circulation configuration, the degree of freedom of the applicable circulation pump increases. For example, a circulation pump having a simple configuration and low cost can be used or a load of a cooler (not illustrated) provided in a main body side path can be reduced. Accordingly, there is an advantage that the cost of the printing apparatus can be decreased. This advantage is high in the line head having a relatively large value of the flow rate A or the flow rate F. Accordingly, a line head having a longer longitudinal length among the line heads is beneficial.

Meanwhile, the first circulation configuration is more advantageous than the second circulation configuration. That is, in the second circulation configuration, since the flow rate of the liquid flowing through the liquid ejection unit 300 in the print standby state becomes maximal, a higher negative pressure is applied to the ejection openings as the ejection amount per unit area of the image (hereinafter, also referred to as a low-duty image) becomes smaller. For this reason, when the passage width is narrow and the negative pressure is high, a high negative pressure is applied to the ejection opening in the low-duty image in which unevenness easily appears. Accordingly, there is concern that printing quality may be deteriorated in accordance with an increase in the number of so-called satellite droplets ejected along with main droplets of the ink.

Meanwhile, in the case of the first circulation configuration, since a high negative pressure is applied to the ejection opening when the image (hereinafter, also referred to as a high-duty image) having a large ejection amount per unit area is formed, there is an advantage that an influence of satellite droplets on the image is small even when many satellite droplets are generated. Two circulation configurations can be desirably selected in consideration of the specifications (the ejection flow rate F, the minimal circulation flow rate A, and the passage resistance inside the head) of the liquid ejection head and the printing apparatus body.

Further, in a case where a charging operation and a recovery operation are performed on the liquid ejection head in the second circulation mode, the ink is first charged into the common supply passage 211, the common collection passage 212, and the common passage connected to these passages and bubbles are discharged. Subsequently, the ink is charged into the print element board 10, the individual supply passage 213, and the individual collection passage 214. Thus, it is possible to suppress bubbles from remaining inside the liquid ejection head 3.

Specifically, a following operation is performed. First, all of the second circulation pump 1004 and the first circulation pumps 1001 and 1002 are driven. By the driving, the ink flows from the first circulation pumps 1001 and 1002 to the second circulation pump 1004 through the liquid supply unit 220, the liquid ejection unit 300, the negative pressure control unit 230, and the liquid supply unit 220 and is collected to the buffer tank 1003. By the flow of the ink, the bubbles existing inside the common supply passage 211, the common collection passage 212, and the common passage of the liquid ejection head 3 are discharged to the outside of the liquid ejection head 3. Subsequently, the driving of the second circulation pump 1004 is stopped and a valve (not illustrated) disposed near the buffer tank 1003 at the downstream side of the liquid ejection head 3 is closed. Then, a pressurization operation is performed by the driving of the first circulation pumps 1001 and 1002. Thus, a charging operation and a recovery operation are performed on the individual supply passage 213, the individual collection passage 214, and the passage inside the print element board 10 provided in the liquid ejection head 3.

Further, even in the second circulation mode, a charging operation and a recovery operation may be performed by a valve or a charging operation and a recovery operation may be performed by a reverse flow of the ink similarly to the first to fourth embodiments.

Further, even in the first and second circulation modes, the deaeration unit is provided at the upstream side of the liquid ejection head 3 similarly to the first embodiment. The deaeration unit includes the deaeration module 104 which is provided between the first circulation pump 1004 and the liquid ejection head 3, the depressurization pump 126 which generates a negative pressure in the deaeration module 104, the valve 237*c*, and the pressure sensor. The deaeration operation and the bubble removing operation using the deaeration unit are also performed similarly to the first embodiment. That is, the deaerated ink of which the dissolved oxygen amount inside the ink is decreased in the deaeration module 104 is circulated while the depressurization pump 126 is driven for a predetermined time (D1) as illustrated in FIG. 3 immediately after the recovery operation on the liquid ejection head 3. Thus, it is possible to remove the bubbles remaining in the ink flowing through the passages connected to the liquid ejection head 3 and the passages inside the liquid ejection head 3. Then, the deaeration operation is performed for a short time (D2) so that the dissolved oxygen amount does not exceed the saturated dissolved oxygen amount until the next recovery operation starts after the bubble removing operation immediately after the recovery operation ends. Thus, it is possible to solve a problem in which the ejection of the ink or the flow of the ink in each of the passages of the liquid ejection head 3 is disturbed by the bubble.

(Description of a Configuration of the Liquid Ejection Head)

Figure 15A:
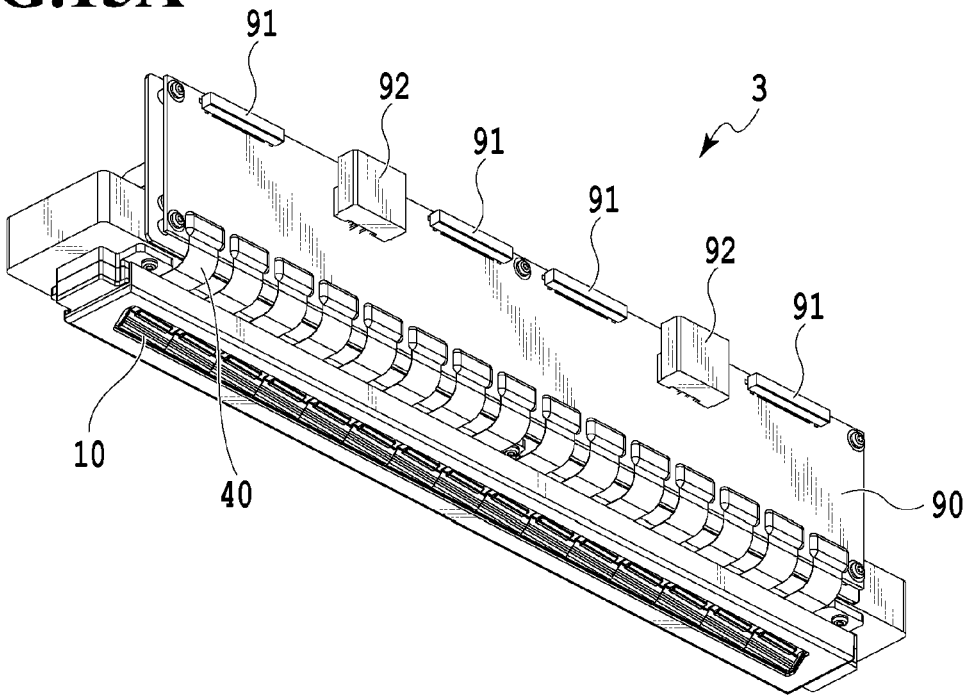
FIGS. 15A and 15B are perspective views illustrating a schematic configuration of the liquid ejection head.
Figure 15B:
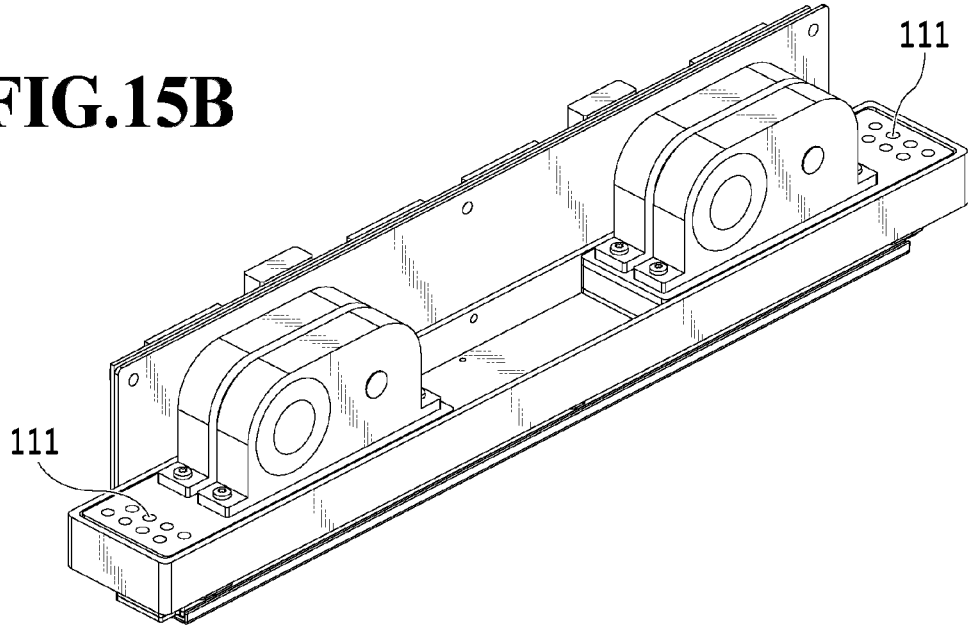

A configuration of the liquid ejection head 3 according to the first embodiment will be described. FIGS. 15A and 15B are perspective views illustrating the liquid ejection head 3 according to the present embodiment. The liquid ejection head 3 is a line type liquid ejection head in which fifteen print element boards 10 capable of ejecting inks of four colors of cyan C, magenta M, yellow Y, and black K are arranged in series on one print element board 10 (an in-line arrangement). As illustrated in FIG. 15A, the liquid ejection head 3 includes the print element boards 10 and a signal input terminal 91 and a power supply terminal 92 which are electrically connected to each other through a flexible circuit board 40 and an electric wiring board 90 capable of supplying electric energy to the print element board 10.

The signal input terminal 91 and the power supply terminal 92 are electrically connected to the control unit of the printing apparatus 1000 so that an ejection drive signal and power necessary for the ejection are supplied to the print element board 10. Since the wirings are integrated by the electric circuit inside the electric wiring board 90, the number of the signal input terminals 91 and the power supply terminals 92 can be decreased compared with the number of the print element boards 10. Accordingly, the number of electrical connection components to be detached when the liquid ejection head 3 is assembled to the printing apparatus 1000 or the liquid ejection head is replaced decreases.

As illustrated in FIG. 15B, the liquid connection portions 111 which are provided at both ends of the liquid ejection head 3 are connected to the liquid supply system of the printing apparatus 1000. Accordingly, the inks of four colors including cyan C, magenta M, yellow Y, and black K4 are supplied from the supply system of the printing apparatus 1000 to the liquid ejection head 3 and the inks passing through the liquid ejection head 3 are collected by the supply system of the printing apparatus 1000. In this way, the inks of different colors can be circulated through the path of the printing apparatus 1000 and the path of the liquid ejection head 3.

Figure 16:
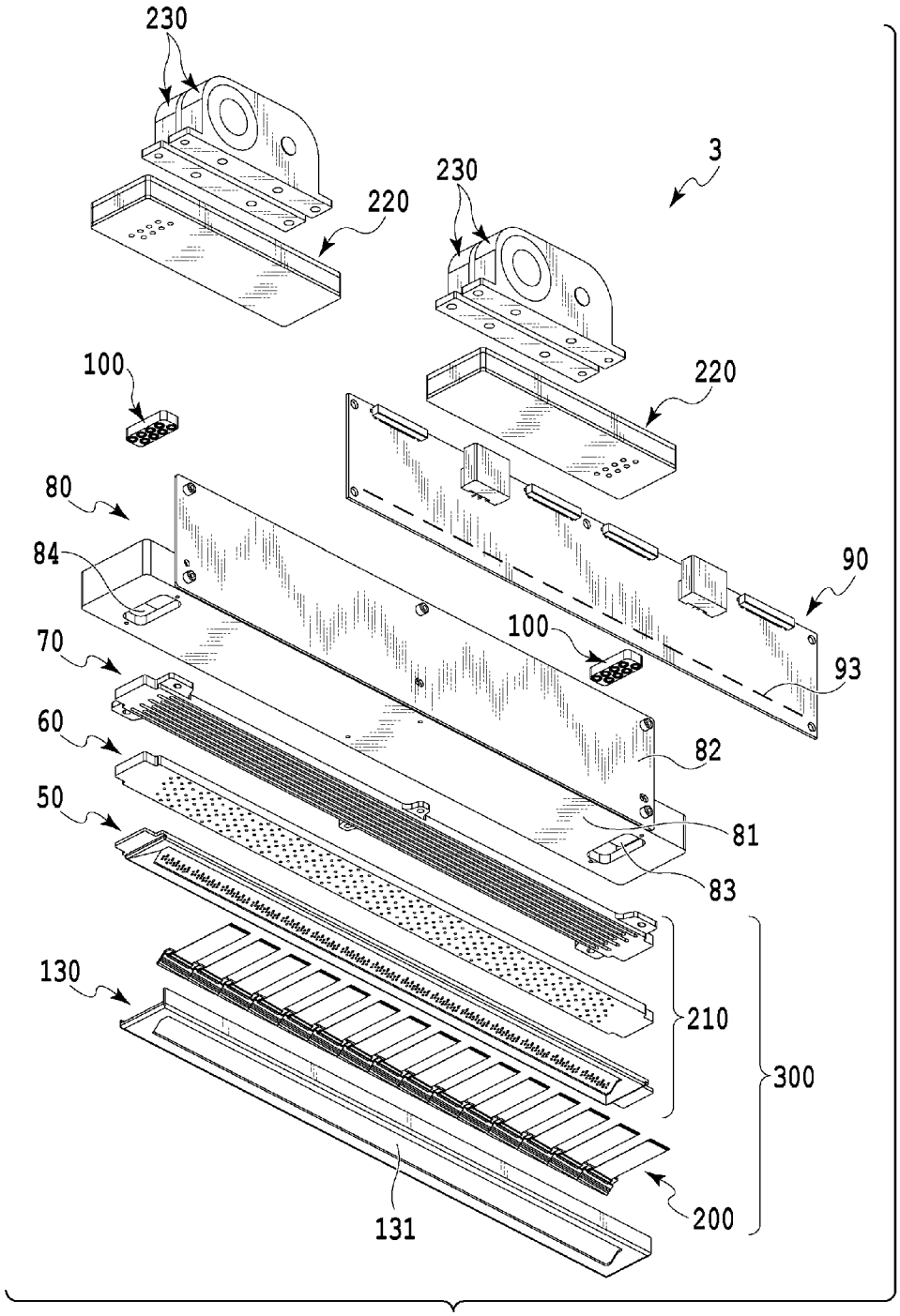
FIG. 16 is an exploded perspective view illustrating units or components constituting the liquid ejection head.

FIG. 16 is an exploded perspective view illustrating components or units constituting the liquid ejection head 3. The liquid ejection unit 300, the liquid supply unit 220, and the electric wiring board 90 are attached to the casing 80. The liquid connection portions 111 (see FIG. 13) are provided in the liquid supply unit 220. Also, in order to remove a foreign material in the supplied ink, filters 221 (see FIGS. 12 and 13) for different colors are provided inside the liquid supply unit 220 while communicating with the openings of the liquid connection portions 111. Two liquid supply units 220 respectively corresponding to two colors are provided with the filters 221. The liquid passing through the filter 221 is supplied to the negative pressure control unit 230 disposed on the liquid supply unit 220 disposed to correspond to each color.

The negative pressure control unit 230 is a unit which includes negative pressure control valves corresponding to different colors. By the function of a spring member or a valve provided therein, a change in pressure loss inside the supply system (the supply system at the upstream side of the liquid ejection head 3) of the printing apparatus 1000 caused by a change in flow rate of the liquid is largely decreased. Accordingly, the negative pressure control unit 230 can stabilize a change of negative pressure at the downstream side (the liquid ejection unit 300) of the negative pressure control unit within a predetermined range. As described in FIG. 2, two negative pressure control valves corresponding to different colors are built inside the negative pressure control unit 230. Two negative pressure control valves are respectively set to different control pressures. Here, the high pressure side communicates with the common supply passage 211 (see FIG. 2) inside the liquid ejection unit 300 and the low pressure side communicates with the common collection passage 212 (see FIG. 2) through the liquid supply unit 220.

The casing 80 includes a liquid ejection unit support portion 81 and an electric wiring board support portion 82 and ensures the rigidity of the liquid ejection head 3 while supporting the liquid ejection unit 300 and the electric wiring board 90. The electric wiring board support portion 82 is used to support the electric wiring board 90 and is fixed to the liquid ejection unit support portion 81 by a screw. The liquid ejection unit support portion 81 is used to correct the warpage or deformation of the liquid ejection unit 300 to ensure the relative position accuracy among the print element boards 10. Accordingly, stripe and unevenness of a printed medium is suppressed.

For that reason, it is desirable that the liquid ejection unit support portion 81 have sufficient rigidity. A metal, such as stainless steel or aluminum, or a ceramic, such as alumina, is desirable as a suitable material. The liquid ejection unit support portion 81 is provided with openings 83 and 84 into which a rubber joint 100 is inserted. The liquid supplied from the liquid supply unit 220 is led to a third passage member 70 constituting the liquid ejection unit 300 through the rubber joint 100.

The liquid ejection unit 300 includes a plurality of ejection modules 200 and a passage member 210. A cover member 130 is attached to a face facing the print medium in the liquid ejection unit 300. Here, the cover member 130 is a member having a picture frame shaped surface and provided with an elongated opening 131 as illustrated in FIG. 16. The print element board 10 and a sealing member 110 (see FIG. 20A to be described later), included in the ejection module 200, are exposed in the opening 131. A peripheral frame of the opening 131 serves as a contact face of a cap member that caps the liquid ejection head 3 in the print standby state. For this reason, it is desirable to form a closed space in a capping state by applying an adhesive, a sealing material, and a filling material along the periphery of the opening 131 to fill unevenness or a gap on the ejection opening face of the liquid ejection unit 300.

Next, a configuration of the passage member 210 included in the liquid ejection unit 300 will be described. As illustrated in FIG. 16, the passage member 210 is obtained by laminating a first passage member 50, a second passage member 60, and a third passage member 70. The passage member 210 distributes the liquid supplied from the liquid supply unit 220 to the ejection modules 200. Further, the passage member 210 is a passage member that returns the liquid re-circulated from the ejection module 200 to the liquid supply unit 220. The passage member 210 is fixed to the liquid ejection unit support portion 81 by a screw and thus warping or deformation of the passage member 210 is suppressed.

Figure 17:
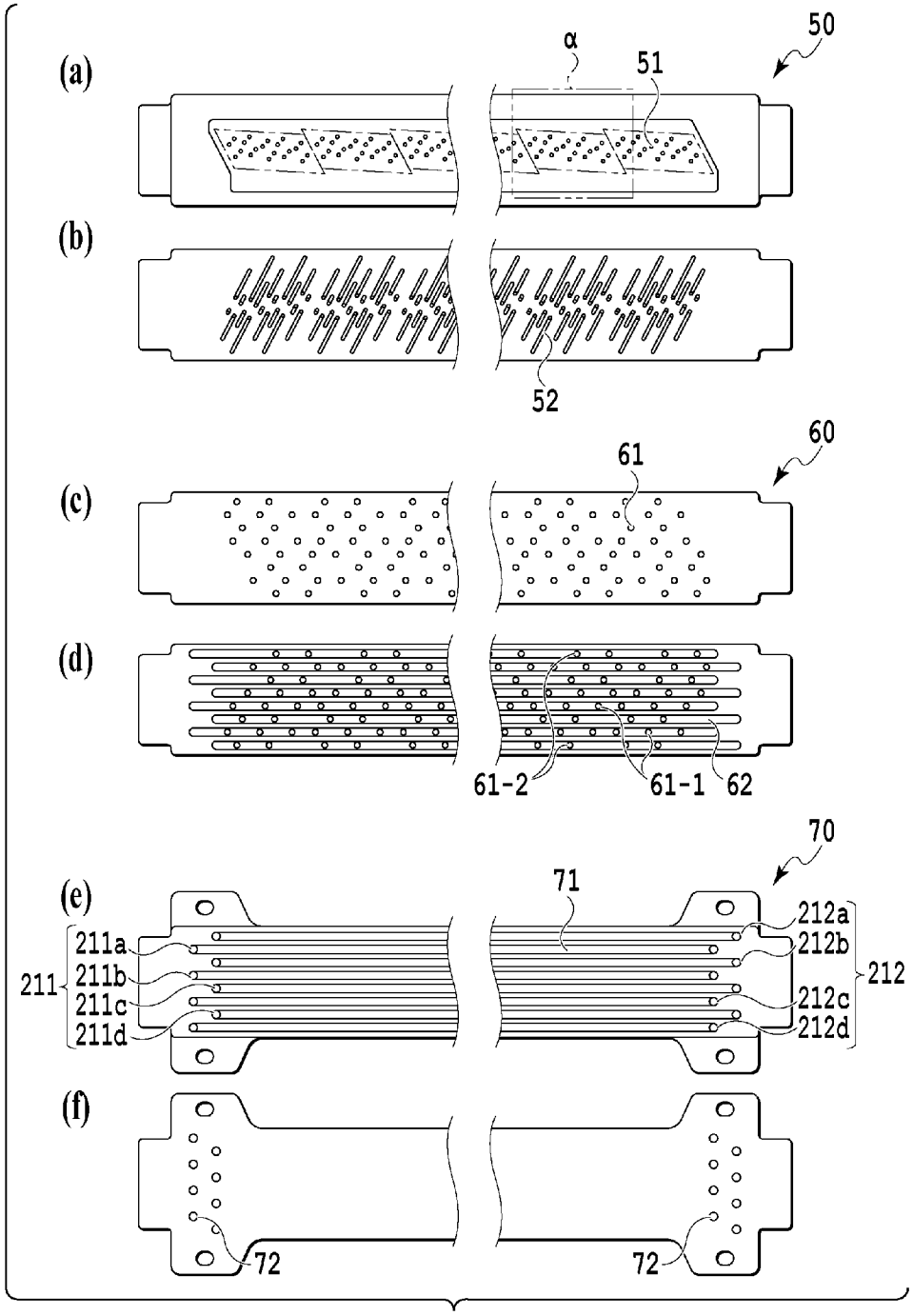
FIG. 17 is a diagram illustrating front and rear faces of first to third passage members.

Parts (a) to (f) of FIG. 17 are diagrams illustrating front and rear faces of the first to third passage members. The part (a) of FIG. 17 illustrates a face onto which the ejection module 200 is mounted in the first passage member 50 and the part (f) of FIG. 17 illustrates a face with which the liquid ejection unit support portion 81 comes into contact in the third passage member 70. The first passage member 50 and the second passage member 60 are bonded to each other so that the parts (b) and (c) of FIG. 17, corresponding to the contact faces of the passage members, face each other, and the second passage member and the third passage member are bonded to each other so that the portions illustrated in the parts (d) and (e) of FIG. 17, corresponding to the contact faces of the passage members, face each other. When the second passage member 60 and the third passage member 70 are bonded to each other, eight common passages (211*a*, 211*b*, 211*c*, 211*d*, 212*a*, 212*b*, 212*c*, 212*d*), extending in the longitudinal direction of the passage member, are formed by common passage grooves 62 and 71 of the passage members.

Accordingly, a set of the common supply passage 211 and the common collection passage 212 is formed inside the passage member 210 to correspond to each color. The ink is supplied from the common supply passage 211 to the liquid ejection head 3 and the ink supplied to the liquid ejection head 3 is collected by the common collection passage 212. A communication opening 72 (see the parts (f) of FIG. 17) of the third passage member 70 communicates with the holes of the rubber joint 100 and is fluidly connected to the liquid supply unit 220 (see FIG. 16). A bottom face of the common passage groove 62 of the second passage member 60 is provided with a plurality of communication openings 61 (a communication opening 61-1 communicating with the common supply passage 211 and a communication opening 61-2 communicating with the common collection passage 212) and communicates with one end of an individual passage groove 52 of the first passage member 50. The other end of the individual passage groove 52 of the first passage member 50 is provided with a communication opening 51 and is fluid-connected to the ejection modules 200 through the communication opening 51. By the individual passage groove 52, the passages can be densely provided at the center side of the passage member.

It is desirable that the first to third passage members be formed of a material having corrosion resistance with respect to a liquid and having a low linear expansion coefficient. For example, a composite material (resin) obtained by adding inorganic filler, such as fiber or fine silica particles, to a base material, such as alumina, LCP (liquid crystal polymer), PPS (polyphenyl sulfide), PSF (polysulfone), can be appropriately used. As a method of forming the passage member 210, three passage members may be laminated and adhered to one another. When a resin composite material is selected as a material, a bonding method using welding may be used.

Figure 18:
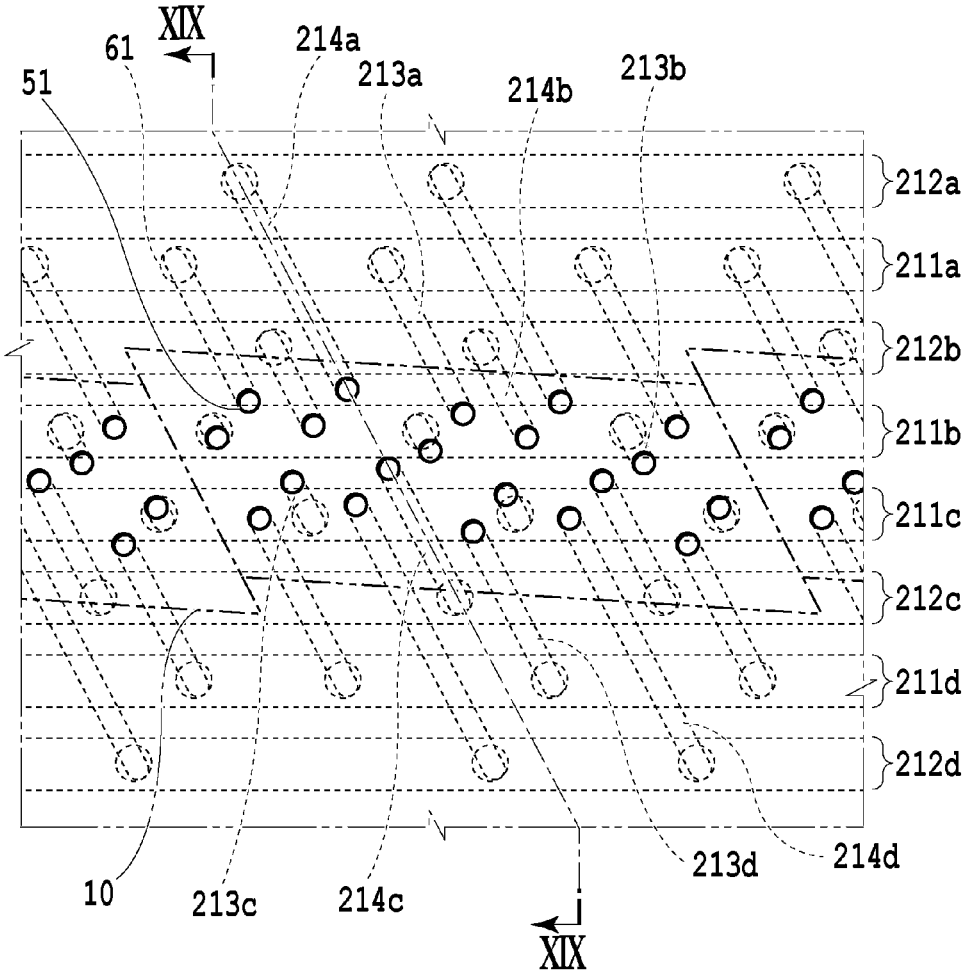
FIG. 18 is an enlarged perspective view illustrating a part α of FIG. 17(*a*)

FIG. 18 is a partially enlarged perspective view illustrating a portion α of a part (a) of FIG. 17 and illustrating the passages inside the passage member 210 formed by bonding the first to third passage members to one another when viewed from a face onto which the ejection module 200 is mounted in the first passage member 50. The common supply passage 211 and the common collection passage 212 are formed such that the common supply passage 211 and the common collection passage 212 are alternately disposed from the passages of both ends. Here, a connection relation among the passages inside the passage member 210 will be described.

The passage member 210 is provided with the common supply passage 211 (211*a*, 211*b*, 211*c*, 211*d*) and the common collection passage 212 (212*a*, 212*b*, 212*c*, 212*d*) extending in the longitudinal direction of the liquid ejection head 3 and provided for each color. The individual supply passages 213 (213*a*, 213*b*, 213*c*, 213*d*) which are formed by the individual passage grooves 52 are connected to the common supply passages 211 for different colors through the communication openings 61. Further, the individual collection passages 214 (214*a*, 214*b*, 214*c*, 214*d*) formed by the individual passage grooves 52 are connected to the common collection passages 212 for different colors through the communication openings 61. With such a passage configuration, the ink can be intensively supplied to the print element board 10 located at the center portion of the passage member from the common supply passages 211 through the individual supply passages 213. Further, the ink can be collected from the print element board 10 to the common collection passages 212 through the individual collection passages 214.

Figure 19:
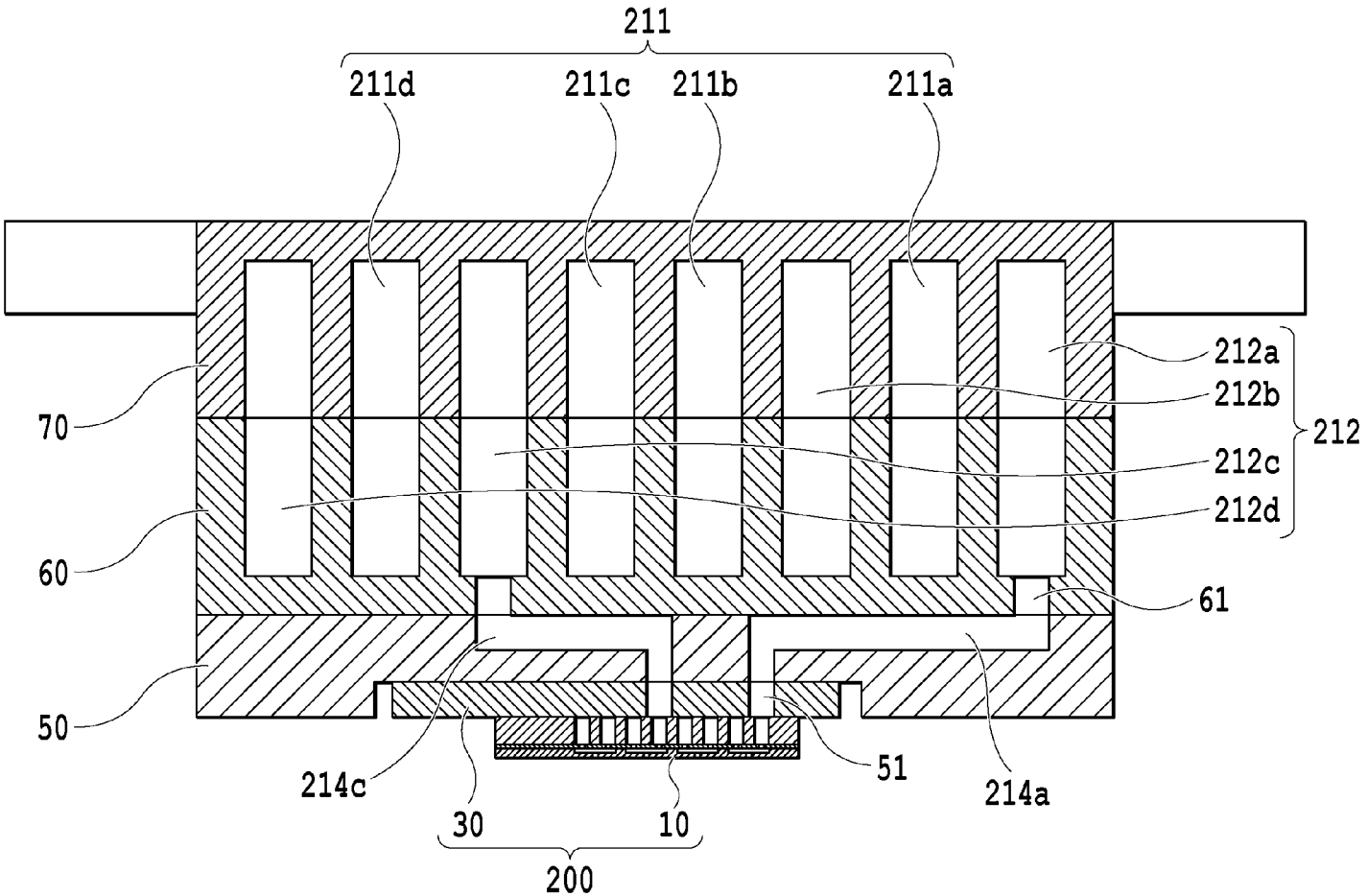
FIG. 19 is a diagram illustrating a cross-section taken along a line XIX-XIX of FIG. 18.

FIG. 19 is a cross-sectional view taken along a line XIX-XIX of FIG. 18. The individual collection passage (214*a*, 214*c*) communicates with the ejection module 200 through the communication opening 51. In FIG. 19, only the individual collection passage (214*a*, 214*c*) is illustrated, but in a different cross-section, the individual supply passage 213 and the ejection module 200 communicates with each other as illustrated in FIG. 18. A support member 30 and the print element board 10 which are included in each ejection module 200 are provided with passages which supply the ink from the first passage member 50 to a print element 15 provided in the print element board 10. Further, the support member 30 and the print element board 10 are provided with passages which collect (re-circulate) a part or the entirety of the liquid supplied to the print element 15 to the first passage member 50.

Here, the common supply passage 211 of each color is connected to the negative pressure control unit 230 (the high pressure side) of corresponding color through the liquid supply unit 220 and the common collection passage 212 is connected to the negative pressure control unit 230 (the low pressure side) through the liquid supply unit 220. By the negative pressure control unit 230, a differential pressure (a difference in pressure) is generated between the common supply passage 211 and the common collection passage 212. For this reason, as illustrated in FIGS. 18 and 19, a flow is generated in order of the common supply passage 211 of each color, the individual supply passage 213, the print element board 10, the individual collection passage 214, and the common collection passage 212 inside the liquid ejection head of the application example having the passages connected to one another.

(Description of Ejection Module)

Figure 20A:
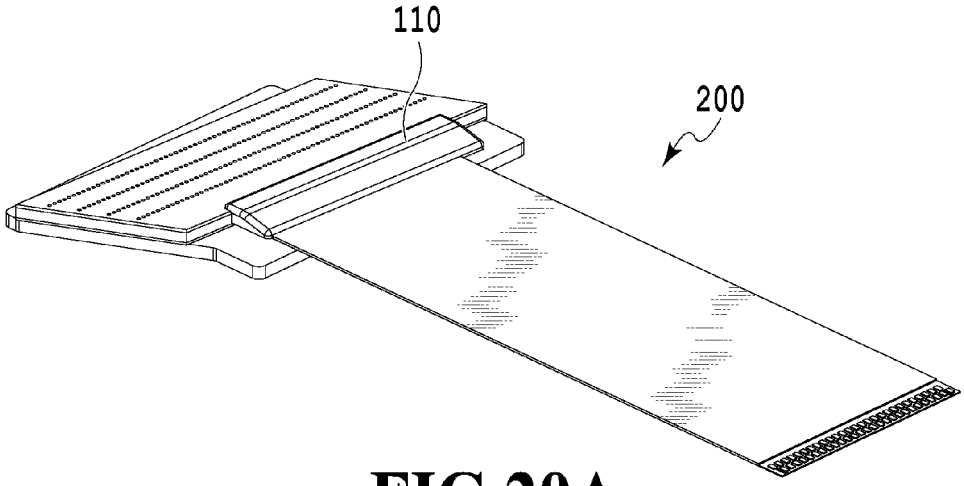
FIG. 20A is a schematic diagram illustrating an ejection module.
Figure 20B:
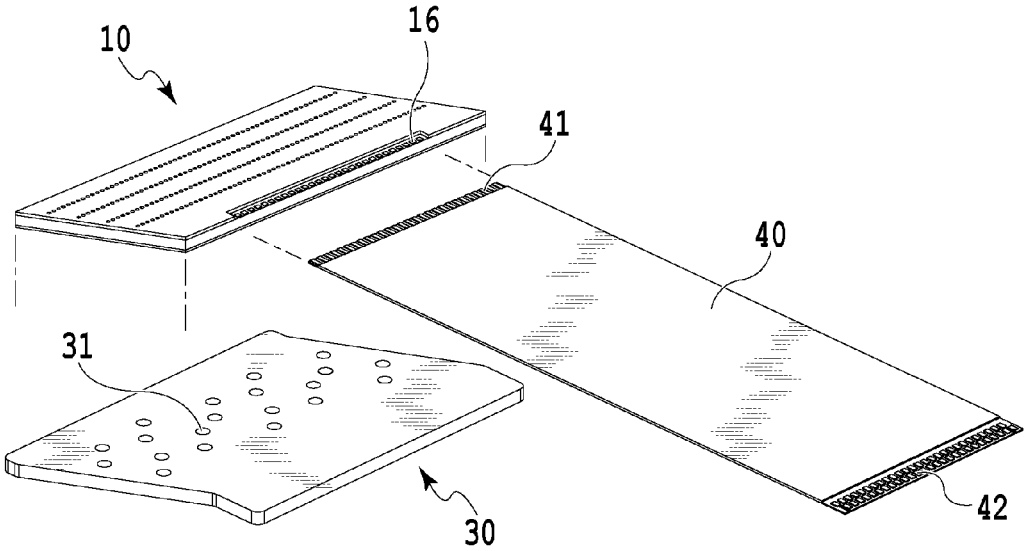
FIG. 20B is an exploded perspective view illustrating the ejection module.

FIG. 20A is a perspective view illustrating one ejection module 200 and FIG. 20B is an exploded view thereof. As a method of manufacturing the ejection module 200, first, the print element board 10 and the flexible circuit board 40 are adhered onto the support member 30 provided with a liquid communication opening 31. Subsequently, a terminal 16 on the print element board 10 and a terminal 41 on the flexible circuit board 40 are electrically connected to each other by wire bonding and the wire bonded portion (the electrical connection portion) is sealed by the sealing member 110.

A terminal 42 which is opposite to the print element board 10 of the flexible circuit board 40 is electrically connected to a connection terminal 93 (see FIG. 27) of the electric wiring board 90. Since the support member 30 serves as a support body that supports the print element board 10 and a passage member that fluid-communicates the print element board 10 and the passage member 210 to each other, it is desirable that the support member have high flatness and sufficiently high reliability while being bonded to the print element board. As a material, for example, alumina or resin is desirable.

(Description of Structure of Print Element Board)

Figure 21A:
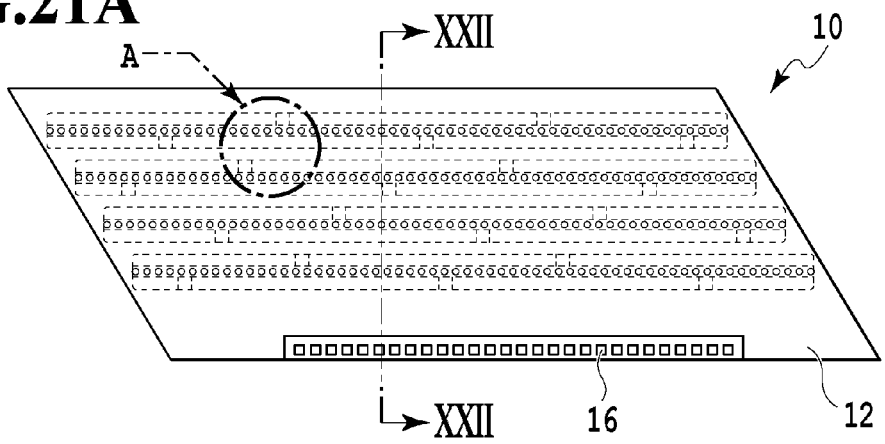
FIGS. 21A, 21B, 21C are schematic diagrams illustrating a print element board.
Figure 21B:
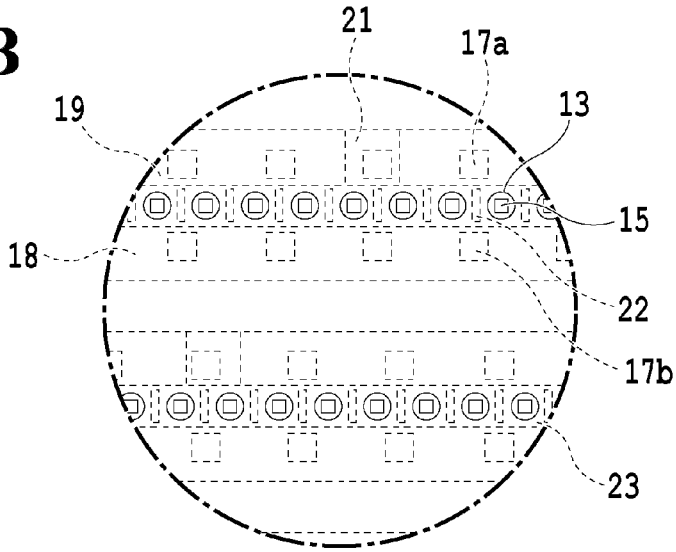
Figure 21C:
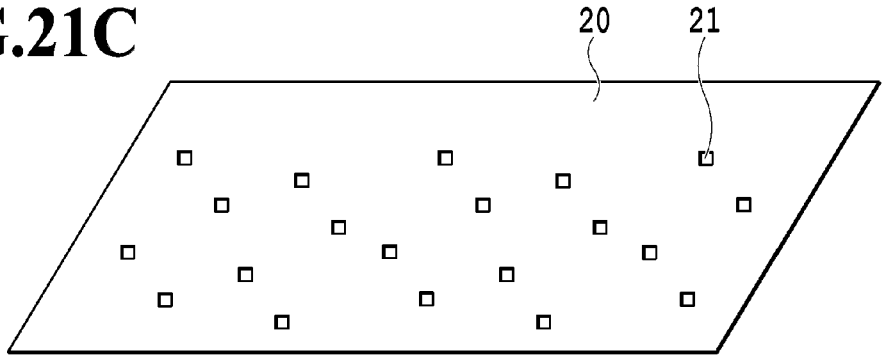

FIG. 21A is a top view illustrating a face provided with an ejection opening 13 in the print element board 10, FIG. 21B is an enlarged view of a part A of FIG. 21A, and FIG. 21C is a top view illustrating a rear face of FIG. 21A. Here, a configuration of the print element board of the application example will be described. As illustrated in FIG. 21A, an ejection opening forming member of the print element board 10 is provided with four ejection opening arrays corresponding to different colors of inks. Further, the extension direction of the ejection opening arrays of the ejection openings 13 will be referred to as an "ejection opening array direction". As illustrated in FIG. 21B, the print element 15 serving as an ejection energy generation element for ejecting the liquid by heat energy is disposed at a position corresponding to each ejection opening 13. A pressure chamber 23 provided inside the print element 15 is defined by a partition wall 22.

The print element 15 is electrically connected to the terminal 16 by an electric wire (not illustrated) provided in the print element board 10. Then, the print element 15 boils the liquid while being heated on the basis of a pulse signal input from a control circuit of the printing apparatus 1000 via the electric wiring board 90 (see FIG. 16) and the flexible circuit board 40 (see FIG. 20B). The liquid is ejected from the ejection opening 13 by a foaming force caused by the boiling. As illustrated in FIG. 21B, a liquid supply path 18 extends at one side along each ejection opening array and a liquid collection path 19 extends at the other side along the ejection opening array. The liquid supply path 18 and the liquid collection path 19 are passages that extend in the ejection opening array direction provided in the print element board 10 and communicate with the ejection opening 13 through a supply opening 17*a* and a collection opening 17*b*.

As illustrated in FIG. 21C, a sheet-shaped lid member 20 is laminated on a rear face of a face provided with the ejection opening 13 in the print element board 10 and the lid member 20 is provided with a plurality of openings 21 communicating with the liquid supply path 18 and the liquid collection path 19. In the application example, the lid member 20 is provided with three openings 21 for each liquid supply path 18 and two openings 21 for each liquid collection path 19. As illustrated in FIG. 21B, openings 21 of the lid member 20 communicate with the communication openings 51 illustrated in the part (a) of FIG. 17, respectively.

It is desirable that the lid member 20 have sufficient corrosion resistance for the liquid. From the viewpoint of preventing mixed color, the opening shape and the opening position of the opening 21 need to have high accuracy. For this reason, it is desirable to form the opening 21 by using a photosensitive resin material or a silicon plate as a material of the lid member 20 through photolithography. In this way, the lid member 20 changes the pitch of the passages by the opening 21. Here, it is desirable to form the lid member by a film-shaped member with a thin thickness in consideration of pressure loss.

Figure 22:
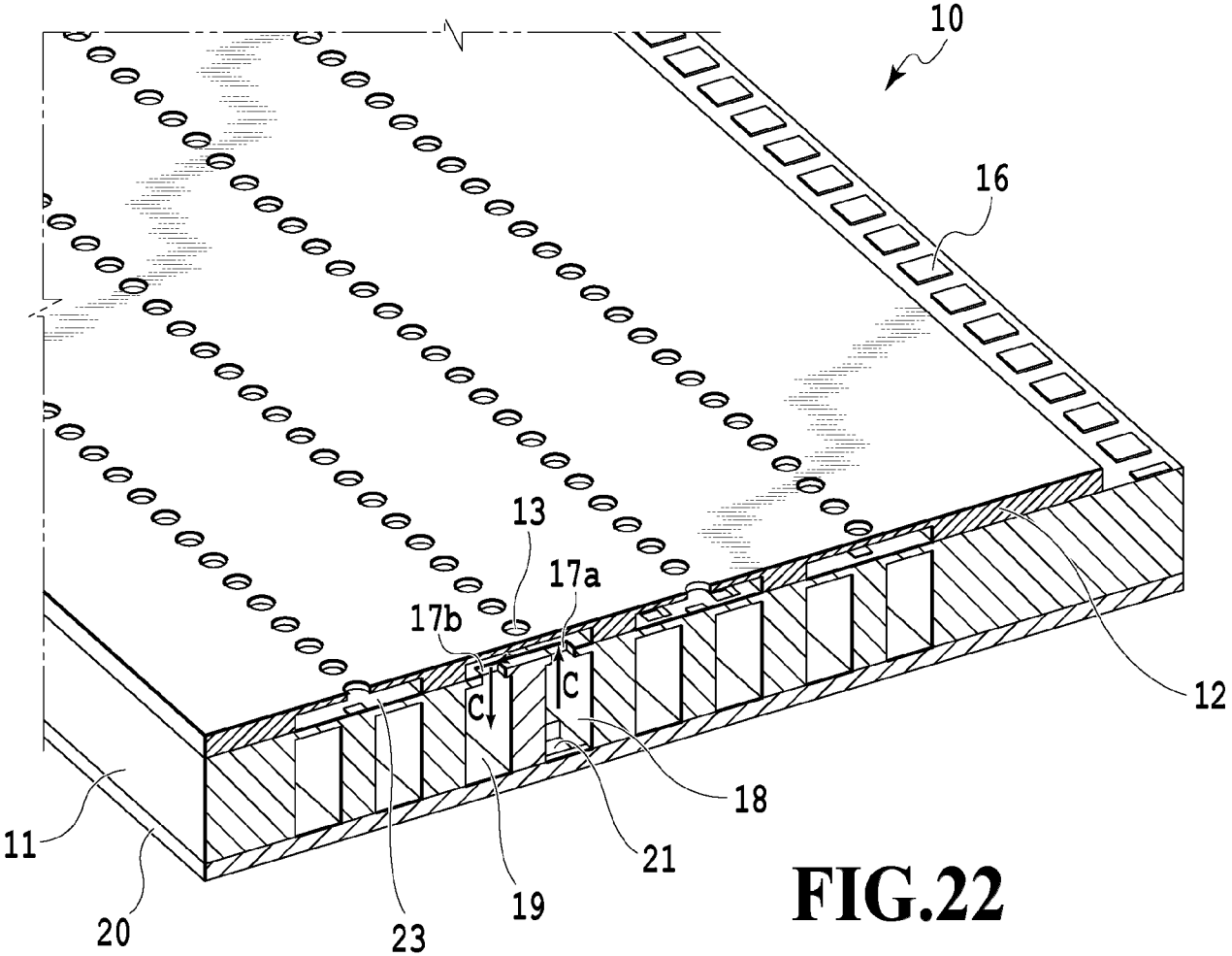
FIG. 22 is a perspective view illustrating cross-sections of the print element board and a cover plate taken along a line XXII-XXII of FIG. 21A.

FIG. 22 is a perspective view illustrating cross-sections of the print element board 10 and the lid member 20 when taken along a line XXII-XXII of FIG. 21A. Here, a flow of the liquid inside the print element board 10 will be described. The lid member 20 serves as a lid that forms a part of walls of the liquid supply path 18 and the liquid collection path 19 formed in a substrate 11 of the print element board 10. The print element board 10 is formed by laminating the substrate 11 formed of Si and the ejection opening forming member 12 formed of photosensitive resin and the lid member 20 is bonded to a rear face of the substrate 11.

One face of the substrate 11 is provided with the print element 15 (see FIG. 21B) and a rear face thereof is provided with grooves forming the liquid supply path 18 and the liquid collection path 19 extending along the ejection opening array. The liquid supply path 18 and the liquid collection path 19 which are formed by the substrate 11 and the lid member 20 are respectively connected to the common supply passage 211 and the common collection passage 212 inside each passage member 210 and a differential pressure is generated between the liquid supply path 18 and the liquid collection path 19. When the liquid is ejected from the ejection opening 13 to print an image, the liquid inside the liquid supply path 18 provided inside the substrate 11 at the ejection opening not ejecting the liquid flows toward the liquid collection path 19 through the supply opening 17*a*, the pressure chamber 23, and the collection opening 17*b* by the differential pressure (see an arrow C of FIG. 22). By the flow, foreign materials, bubbles, and thickened ink produced by the evaporation from the ejection opening 13 in the ejection opening 13 or the pressure chamber 23 not involved with a printing operation can be collected by the liquid collection path 19. Further, the thickening of the ink of the ejection opening 13 or the pressure chamber 23 can be suppressed.

The liquid which is collected to the liquid collection path 19 is collected in order of the communication opening 51 inside the passage member 210, the individual collection passage 214, and the common collection passage 212 through the opening 21 of the lid member 20 and the liquid communication opening 31 (see FIG. 20B) of the support member 30. Then, the liquid is collected by the collection path of the printing apparatus 1000. That is, the liquid supplied from the printing apparatus body to the liquid ejection head 3 flows in the following order to be supplied and collected.

First, the liquid flows from the liquid connection portion 111 of the liquid supply unit 220 into the liquid ejection head 3. Then, the liquid is sequentially supplied through the rubber joint 100, the communication opening 72 and the common passage groove 71 provided in the third passage member, the common passage groove 62 and the communication opening 61 provided in the second passage member, and the individual passage groove 52 and the communication opening 51 provided in the first passage member. Subsequently, the liquid is supplied to the pressure chamber 23 while sequentially passing through the liquid communication opening 31 provided in the support member 30, the opening 21 provided in the lid member 20, and the liquid supply path 18 and the supply opening 17*a* provided in the substrate 11. Subsequently, the liquid is supplied to the pressure chamber 23 while sequentially passing through the liquid communication opening 31 provided at the support member 30, the opening 21 provided at the cover plate 20, and the liquid supply path 18 and the supply opening 17*a* provided at the substrate 11.

In the liquid supplied to the pressure chamber 23, the liquid which is not ejected from the ejection opening 13 sequentially flows through the collection opening 17*b* and the liquid collection path 19 provided in the substrate 11, the opening 21 provided in the lid member 20, and the liquid communication opening 31 provided in the support member 30. Subsequently, the liquid sequentially flows through the communication opening 51 and the individual passage groove 52 provided in the first passage member, the communication opening 61 and the common passage groove 62 provided in the second passage member, the common passage groove 71 and the communication opening 72 provided in the third passage member 70, and the rubber joint 100. Then, the liquid flows from the liquid connection portion 111 provided in the liquid supply unit 220 to the outside of the liquid ejection head 3.

In the first circulation configuration illustrated in FIG. 2, the liquid which flows from the liquid connection portion 111 is supplied to the rubber joint 100 through the negative pressure control unit 230. Further, in the second circulation configuration illustrated in FIG. 3, the liquid, which is collected from the pressure chamber 23, passes through the rubber joint 100 and flows from the liquid connection portion 111 to the outside of the liquid ejection head through the negative pressure control unit 230.

That is, the liquid may flow from the other end of the common supply passage 211 to the liquid supply unit 220 while not flowing into the individual supply passage 213*a* by the liquid which flows from one end of the common supply passage 211. In this way, since the path is provided so that the liquid flows therethrough without passing through the print element board 10, the reverse flow of the circulation flow of the liquid can be suppressed even in the print element board 10 including the small passage with a high flow resistance as in the application example. In this way, since the thickening of the liquid in the vicinity of the ejection opening or the pressure chamber 23 can be suppressed in the liquid ejection head 3 of the present embodiment, a slippage or a non-ejection can be suppressed. As a result, a high-quality image can be printed.

(Description of Positional Relation Among Print Element Boards)

Figure 23:
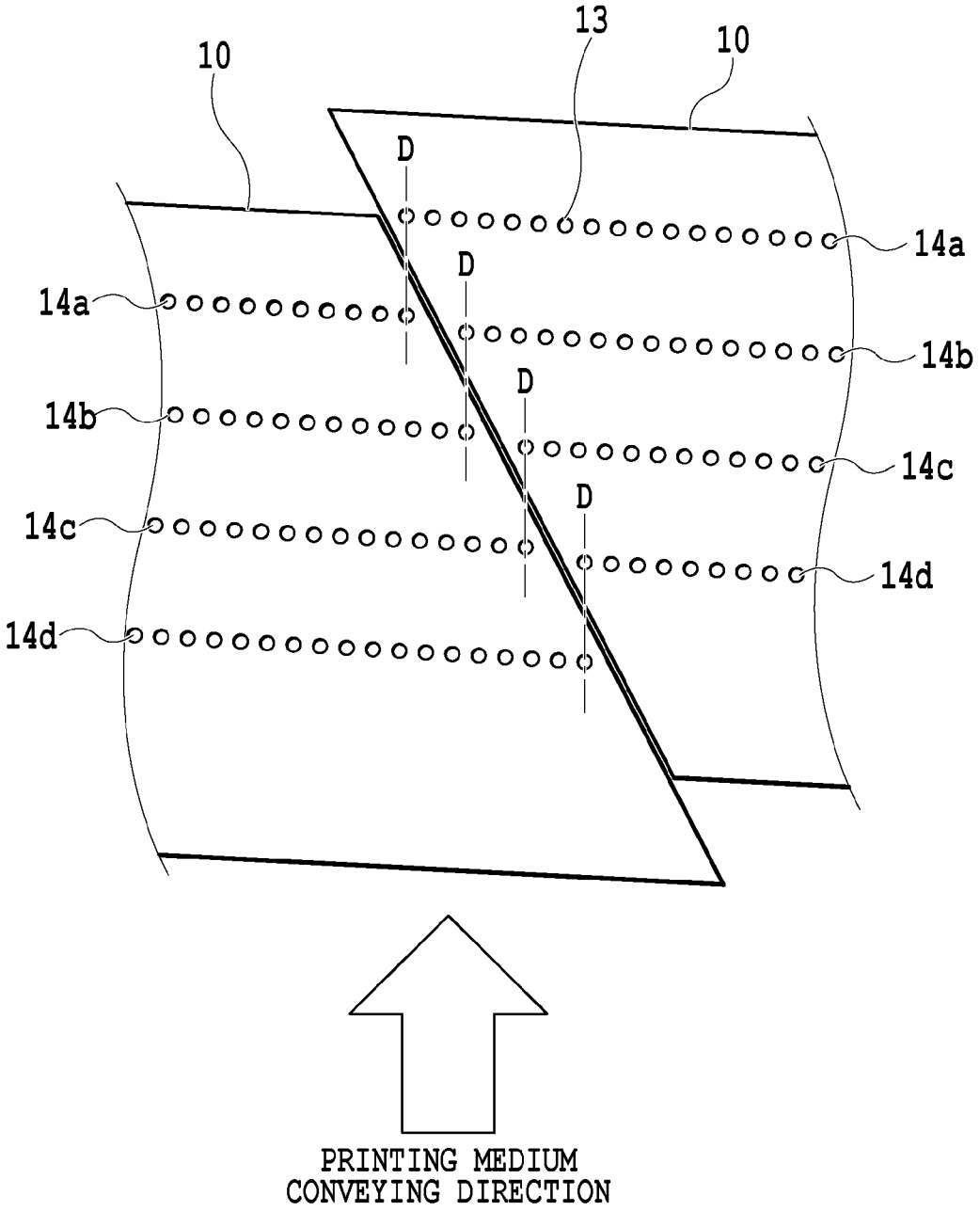
FIG. 23 is a partially enlarged top view illustrating an adjacent portion in the print element board between two adjacent ejection modules.

FIG. 23 is a partially enlarged top view illustrating an adjacent portion of the print element board in two adjacent ejection modules. In the present embodiment, a substantially parallelogram print element board is used. Ejection opening arrays (14*a* to 14*d*) having the ejection openings 13 arranged in each print element board 10 are disposed to be inclined while having a predetermined angle with respect to the longitudinal direction of the liquid ejection head 3. Then, the ejection opening array at the adjacent portion between the print element boards 10 is formed such that at least one ejection opening overlaps in the print medium conveying direction. In FIG. 23, two ejection openings on a line D overlap each other.

With such an arrangement, even in a case where the position of the print element board 10 is slightly deviated from a predetermined position, black stripes or voids of a printed image cannot be visually recognized by a driving control of the overlapping ejection openings. Even in a case were the plurality of print element boards 10 are arranged in a linear shape (an in-line shape) instead of a stagger arrangement shape, it is possible to prepare a countermeasure for black stripes or voids at the connection portion between the print element boards 10 while suppressing an increase in length of the liquid ejection head 10 in the print medium conveying direction by the configuration illustrated in FIG. 23. Additionally, in the embodiment, the principal plane of the print element board is formed in a parallelogram shape, but the invention is not limited thereto. For the embodiment, even in a case where the print element board having a rectangular shape, a trapezoid shape, or the other shapes is used, the configuration of the invention can be desirably applied thereto.

Fourth Embodiment

Hereinafter, configurations of an inkjet printing apparatus 2000 and a liquid ejection head 2003 according to a fourth embodiment of the invention will be described with reference to the drawings. In the description below, only a difference from the first embodiment will be described and a description of the same components as those of the first embodiment will be omitted.

(Description of Inkjet Printing Apparatus)

Figure 31:
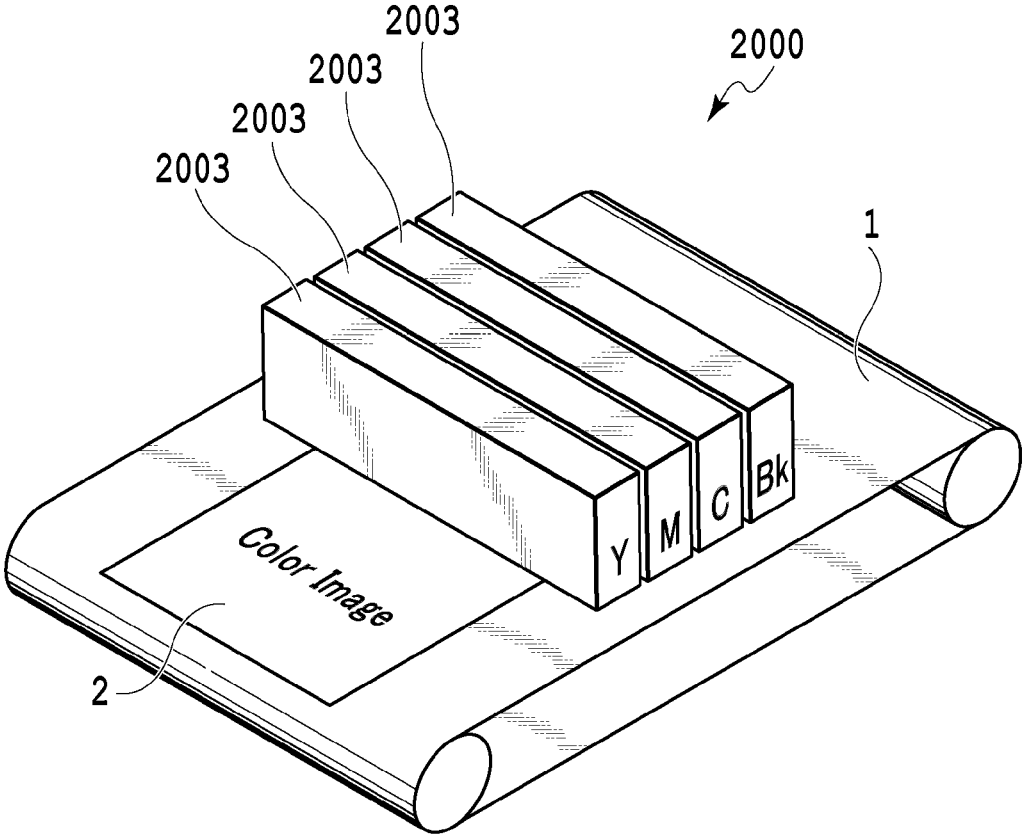
FIG. 31 is a schematic diagram illustrating an inkjet printing apparatus according to the sixth embodiment.

FIG. 31 is a diagram illustrating the inkjet printing apparatus 2000 according to the embodiment used to eject the liquid. The printing apparatus 2000 of the embodiment is different from the first embodiment in that a full color image is printed on the print medium by a configuration in which four monochromic liquid ejection heads 2003 respectively corresponding to the inks of cyan C, magenta M, yellow Y, and black K are disposed in parallel. In the first embodiment, the number of the ejection opening rows which can be used for one color is one. However, in the embodiment, the number of the ejection opening rows which can be used for one color is twenty. For this reason, when print data is appropriately distributed to a plurality of ejection opening rows to print an image, an image can be printed at a higher speed.

Further, even when there are the ejection openings that do not eject the liquid, the liquid is ejected complementarily from the ejection openings of the other rows located at positions corresponding to the non-ejection openings in the print medium conveying direction. The reliability is improved and thus a commercial image can be appropriately printed. Similarly to the first embodiment, the supply system, the buffer tank 1003 (see FIGS. 12 and 13), and the main tank 1006 (see FIGS. 12 and 13) of the printing apparatus 2000 are fluidly connected to the liquid ejection heads 2003. Further, an electrical control unit which transmits power and ejection control signals to the liquid ejection head 2003 is electrically connected to the liquid ejection heads 2003.

(Description of Circulation Path)

Similarly to the third embodiment, the first and second circulation modes illustrated in FIG. 12 or 13 can be used in a liquid circulation path between the printing apparatus 2000 and a liquid ejection head 2003. Further, the charging operation and the recovery operation for the liquid ejection head 2003 can be also performed similarly to the third embodiment.

Further, even in a fourth embodiment, the deaeration unit including the deaeration module, the depressurization pump, the valve, and the pressure sensor is provided at the upstream side of each of the liquid ejection heads 2003 similarly to the first embodiment and the third embodiment. Then, the deaerated ink of which the dissolved oxygen amount is decreased in the deaeration module 104 is circulated while the depressurization pump 126 is driven for a predetermined time (D1) as illustrated in FIG. 3 immediately after the recovery operation is performed on each of the liquid ejection heads 2003. Thus, it is possible to remove the bubbles remaining in the ink flowing through the passages connected to the liquid ejection head 2003 and the passages inside the liquid ejection heads 2003. Then, the deaeration operation is performed for a short time (D2) so that the dissolved oxygen amount does not exceed the saturated dissolved oxygen amount until the next recovery operation starts after the bubble removing operation immediately after the recovery operation ends. Thus, it is possible to solve a problem in which the ejection of the ink or the flow of the ink in each of the passages of the liquid ejection heads 2003 is disturbed by the bubble.

(Description of Structure of Liquid Ejection Head)

Figure 24A:
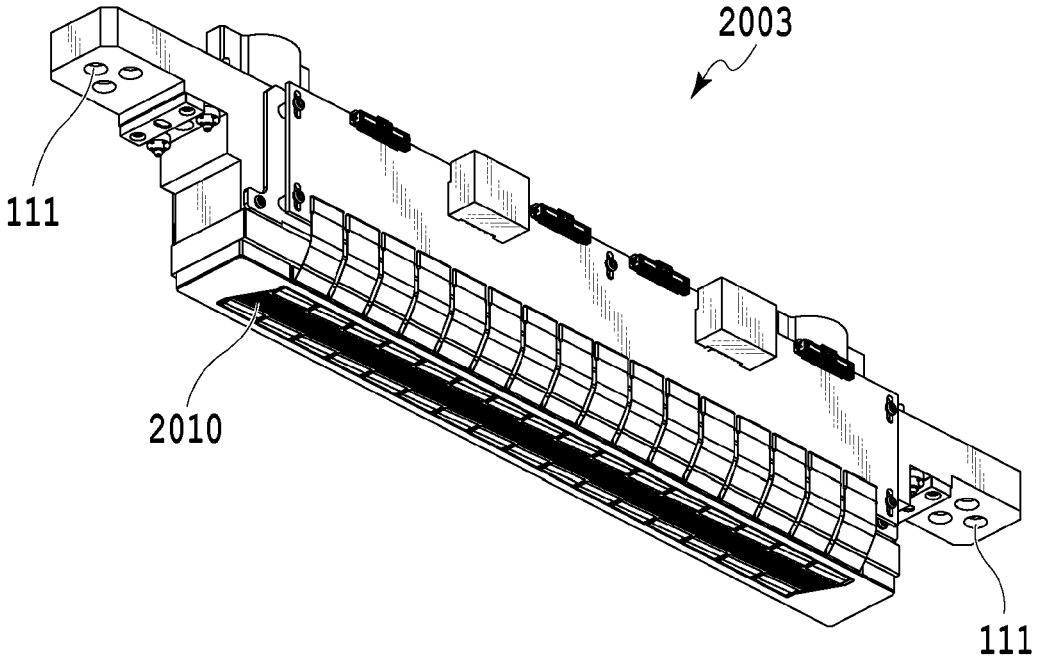
FIGS. 24A and 24B are perspective views illustrating a liquid ejection head according to a sixth embodiment.
Figure 24B:
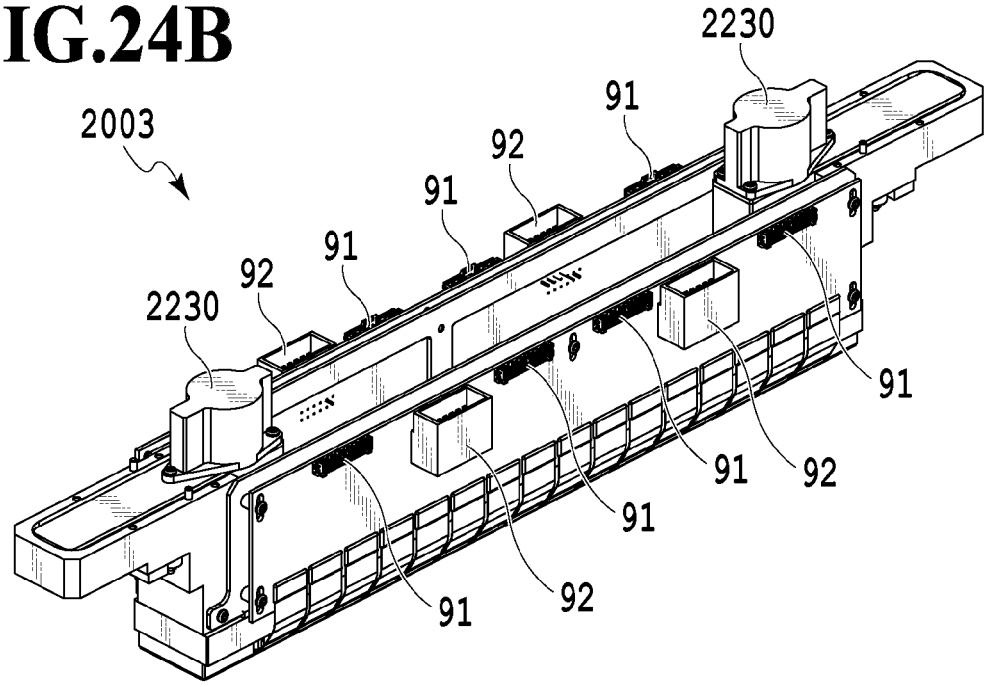

FIGS. 24A and 24B are perspective views illustrating the liquid ejection head 2003 according to the embodiment. Here, a structure of the liquid ejection head 2003 according to the embodiment will be described. The liquid ejection head 2003 is an inkjet line type (page wide type) print head which includes sixteen print element boards 2010 arranged linearly in the longitudinal direction of the liquid ejection head 2003 and can print an image by one kind of liquid. Similarly to the first embodiment, the liquid ejection head 2003 includes the liquid connection portion 111, the signal input terminal 91, and the power supply terminal 92. However, since the liquid ejection head 2003 of the embodiment includes many ejection opening rows compared with the first embodiment, the signal input terminal 91 and the power supply terminal 92 are disposed at both sides of the liquid ejection head 2003. This is because a decrease in voltage or a delay in transmission of a signal caused by the wiring portion provided in the print element board 2010 needs to be reduced.

Figure 25:
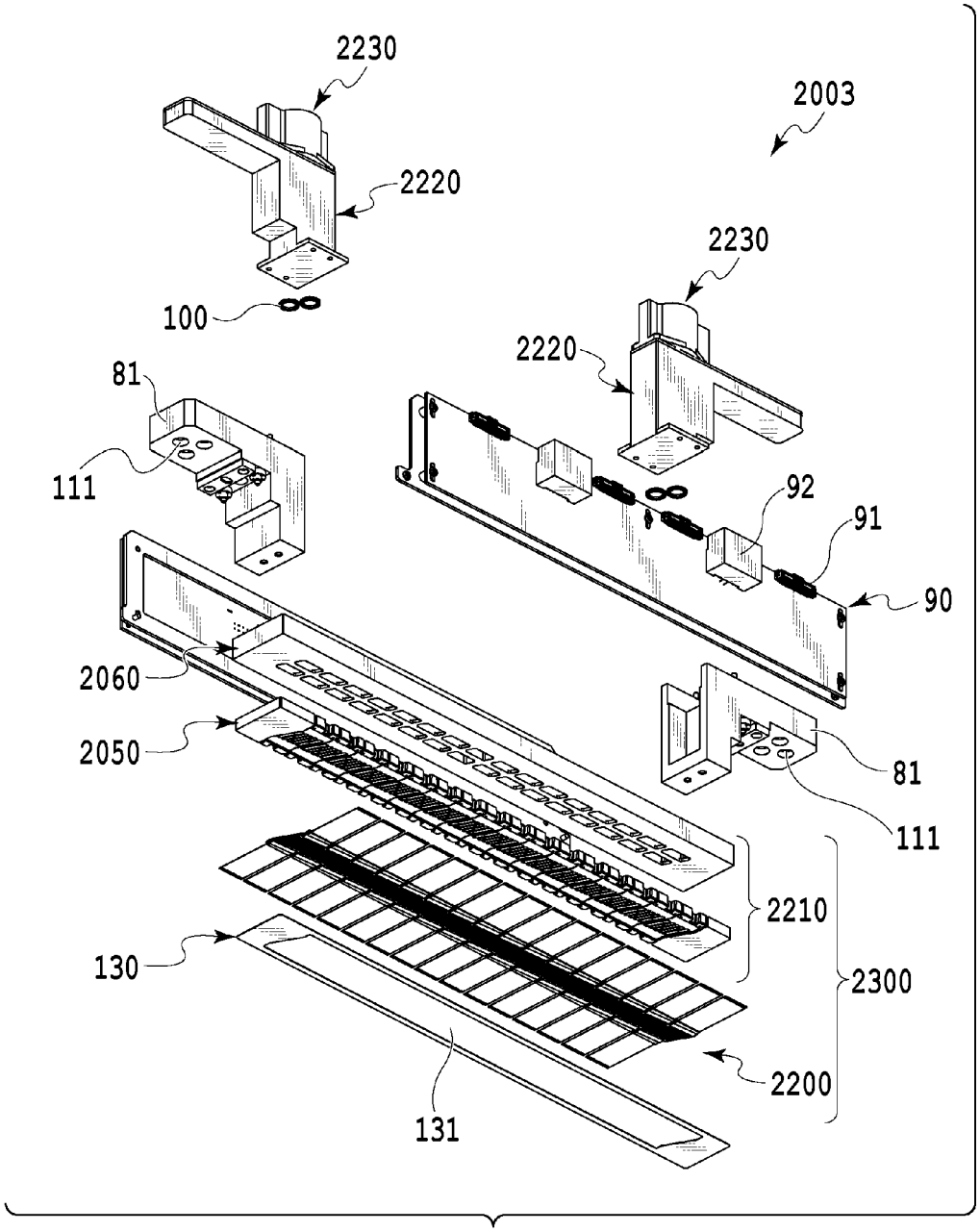
FIG. 25 is an exploded perspective view of the liquid ejection head illustrated in FIG. 24A.

FIG. 25 is an oblique exploded view illustrating the liquid ejection head 2003 and components or units constituting the liquid ejection head 2003 according to the functions thereof. The function of each of units and members or the liquid flow sequence inside the liquid ejection head is basically similar to that of the first embodiment, but the function of guaranteeing the rigidity of the liquid ejection head is different. In the first embodiment, the rigidity of the liquid ejection head is mainly guaranteed by the liquid ejection unit support portion 81, but in the liquid ejection head 2003 of the second embodiment, the rigidity of the liquid ejection head is guaranteed by a second passage member 2060 included in a liquid ejection unit 2300.

A liquid ejection unit support portion 81 of the embodiment is connected to both ends of a second passage member 2060 and a liquid ejection unit 2300 is mechanically connected to a carriage of the printing apparatus 2000 so that the liquid ejection head 2003 is positioned. A liquid supply unit 2220 including the negative pressure control unit 2230 and an electric wiring board 90 are connected to the liquid ejection unit support portion 81. A filter (not illustrated) is provided inside each of two liquid supply units 2220.

Two negative pressure control units 2230 are different from each other and are configured to control high and low negative pressures. Further, as illustrated in FIG. 25, in a case where the high negative pressure control unit 2230 and the low negative pressure control unit 2230 are respectively provided at both ends of the liquid ejection head 2003, the liquid flows of the common supply passage and the common collection passage extending in the longitudinal direction of the liquid ejection head 2003 face each other. In such a configuration, a heat exchange operation between the common supply passage and the common collection passage is further performed and thus a temperature difference between two common passages is reduced. Thus, since a temperature difference among the print element boards 2010 provided along the common passage is reduced, there is an advantage that unevenness in printing operation is not easily caused by a temperature difference.

Next, a detailed configuration of a passage member 2210 of the liquid ejection unit 2300 will be described. As illustrated in FIG. 25, the passage member 2210 is obtained by laminating a first passage member 2050 and a second passage member 2060 and distributes the liquid supplied from the liquid supply unit 2220 to ejection modules 2200. The passage member 2210 serves as a passage member that returns the liquid re-circulated from the ejection module 2200 to the liquid supply unit 2220. The second passage member 2060 of the passage member 2210 is a passage member having a common supply passage and a common collection passage formed therein and improving the rigidity of the liquid ejection head 2003. For this reason, it is desirable that a material of the second passage member 2060 have sufficient corrosion resistance for the liquid and high mechanical strength. Specifically, stainless steel, titanium, or alumina can be used.

Figure 26:
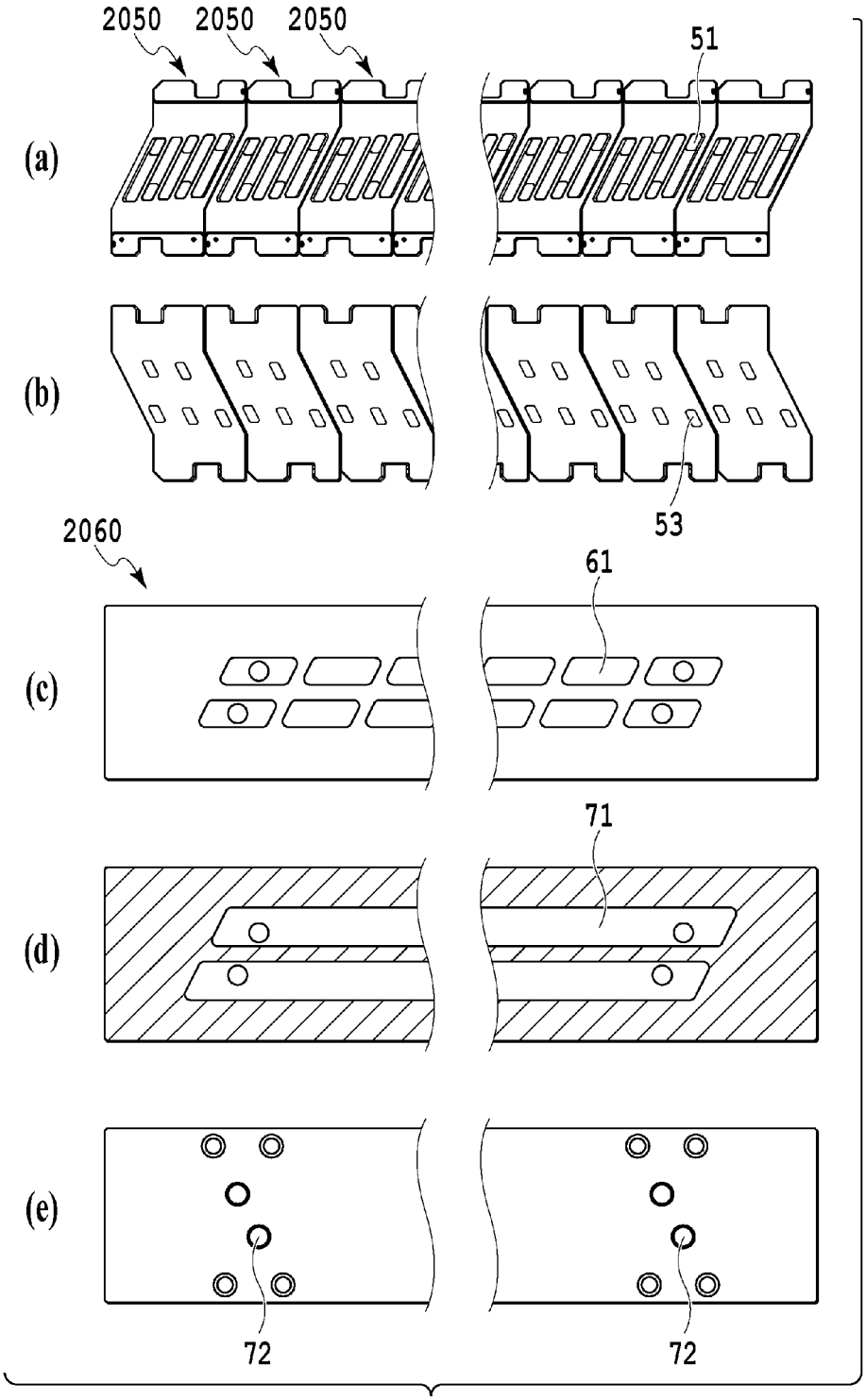
FIG. 26 is a diagram illustrating first and second passage members.

Part (a) of FIG. 26 is a diagram illustrating a face onto which the ejection module 2200 is mounted in the first passage member 2050 and part (b) of FIG. 26 is a diagram illustrating a rear face thereof and a face contacting the second passage member 2060. Differently from the first embodiment, the first passage member 2050 of the embodiment has a configuration in which a plurality of members are disposed adjacently to respectively correspond to the ejection modules 2200. By employing such a split structure, a plurality of modules can be arranged to correspond to a length of the liquid ejection head 2003. Accordingly, this structure can be appropriately used particularly in a relatively long liquid ejection head corresponding to, for example, a sheet having a size of B2 or more.

As illustrated in part (a) of FIG. 26, the communication opening 51 of the first passage member 2050 fluidly communicates with the ejection module 2200. As illustrated in part (b) of FIG. 26, the individual communication opening 53 of the first passage member 2050 fluidly communicates with the communication opening 61 of the second passage member 2060. Part (c) of FIG. 26 illustrates a contact face of the second passage member 60 with respect to the first passage member 2050, part (d) of FIG. 26 illustrates a cross-section of a center portion of the second passage member 60 in the thickness direction, and part (e) of FIG. 26 is a diagram illustrating a contact face of the second passage member 2060 with respect to the liquid supply unit 2220. The function of the communication opening or the passage of the second passage member 2060 is similar to each color of the first embodiment. The common passage groove 71 of the second passage member 2060 is formed such that one side thereof is a common supply passage 2211 illustrated in FIG. 27 and the other side thereof is a common collection passage 2212. These passages are respectively provided along the longitudinal direction of the liquid ejection head 2003 so that the liquid is supplied from one end thereof to the other end thereof. The embodiment is different from the first embodiment in that the liquid flow directions in the common supply passage 2211 and the common collection passage 2212 are opposite to each other.

Figure 27:
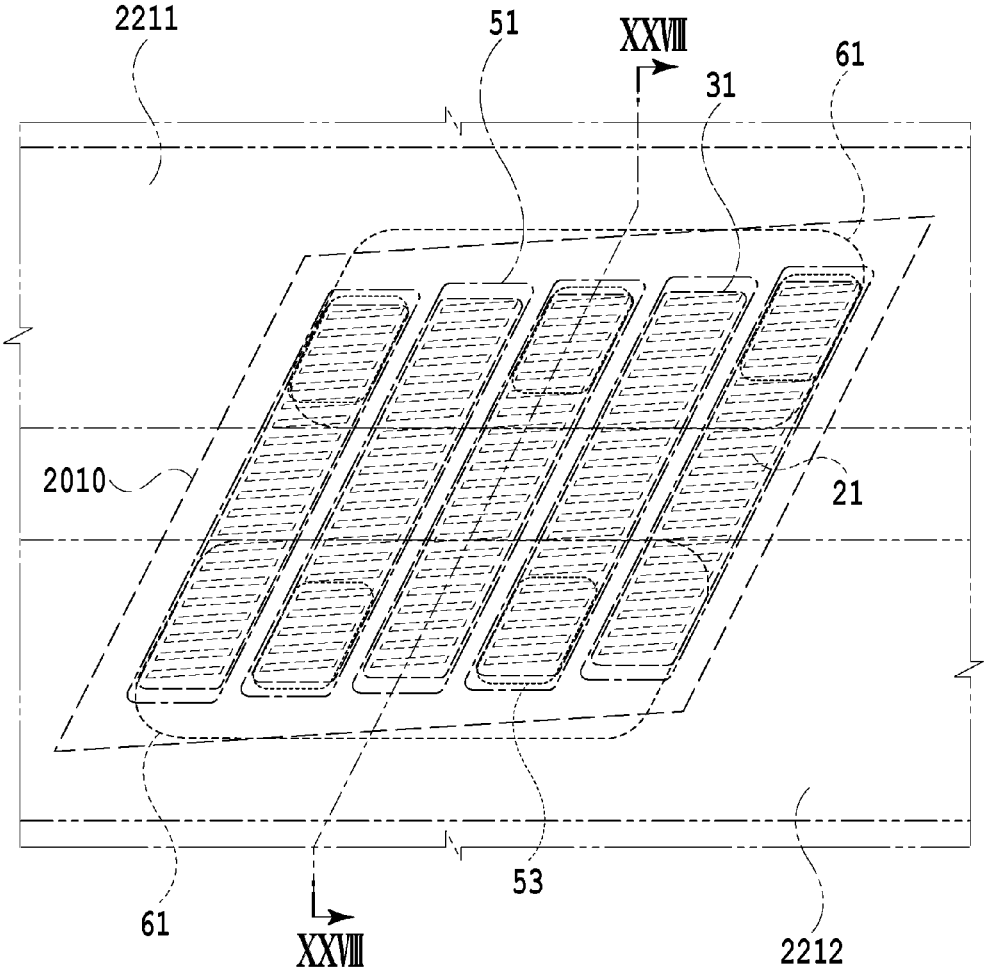
FIG. 27 is a perspective view illustrating a liquid connection relation between a print element board and a passage member.

FIG. 27 is a perspective view illustrating a liquid connection relation between the print element board 2010 and the passage member 2210. A pair of the common supply passage 2211 and the common collection passage 2212 extending in the longitudinal direction of the liquid ejection head 2003 is provided inside the passage member 2210. The communication opening 61 of the second passage member 2060 is connected to the individual communication opening 53 of the first passage member 2050 so that both positions match each other and the liquid supply passage communicating with the communication opening 51 of the first passage member 2050 through the communication opening from the common supply passage 2211 of the second passage member 2060 is formed. Similarly, the liquid the supply path communicating with the communication opening 51 of the first passage member 2050 through the common collection passage 2212 from the communication opening 72 of the second passage member 2060 is also formed.

Figure 28:
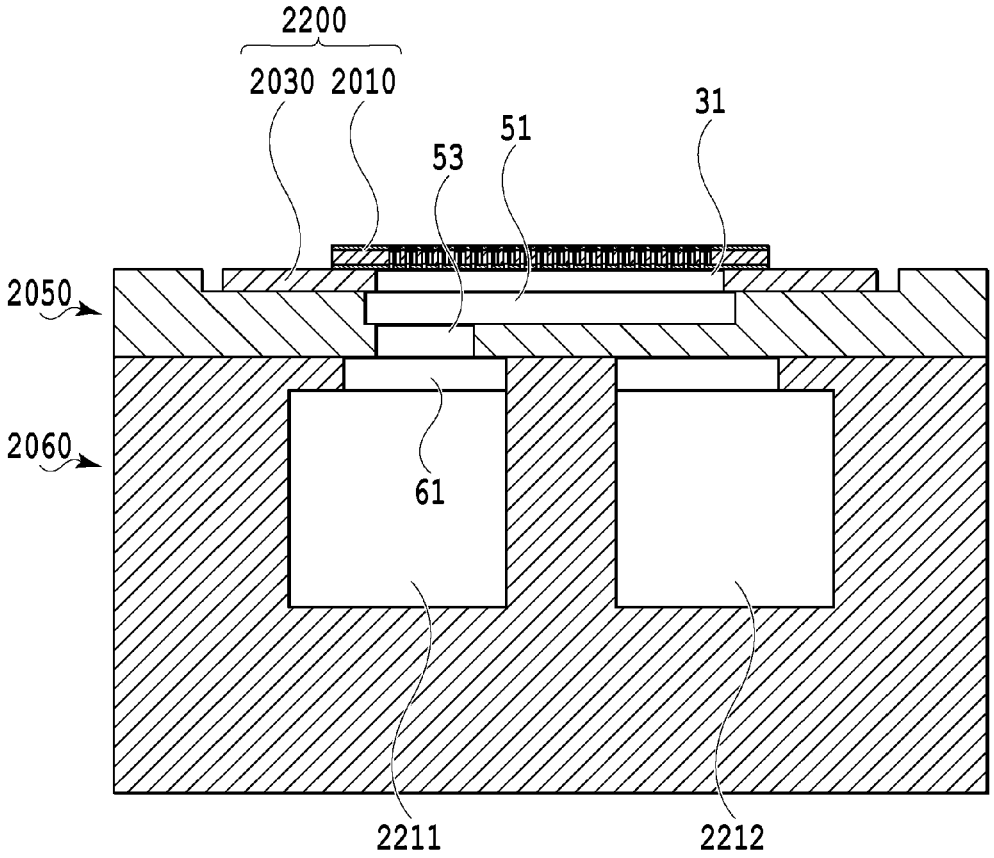
FIG. 28 is a diagram illustrating a cross-section taken along a line XXVIII-XXVIII of FIG. 27.

FIG. 28 is a cross-sectional view taken along a line XXVIII-XXVIII of FIG. 27. The common supply passage 2211 is connected to the ejection module 2200 through the communication opening 61, the individual communication opening 53, and the communication opening 51. Although not illustrated in FIG. 28, it is obvious that the common collection passage 2212 is connected to the ejection module 2200 by the same path in a different cross-section in FIG. 27. Similarly to the first embodiment, each of the ejection module 2200 and the print element board 2010 is provided with a passage communicating with each ejection opening and thus a part or the entirety of the supplied liquid can be re-circulated while passing through the ejection opening that does not perform the ejection operation. Further, similarly to the first embodiment, the common supply passage 2211 is connected to the negative pressure control unit 2230 (the high pressure side) and the common collection passage 2212 is connected to the negative pressure control unit 2230 (the low pressure side) through the liquid supply unit 2220. Thus, a flow is formed so that the liquid flows from the common supply passage 2211 to the common collection passage 2212 through the pressure chamber of the print element board 2010 by the differential pressure.

(Description of Ejection Module)

Figure 29A:
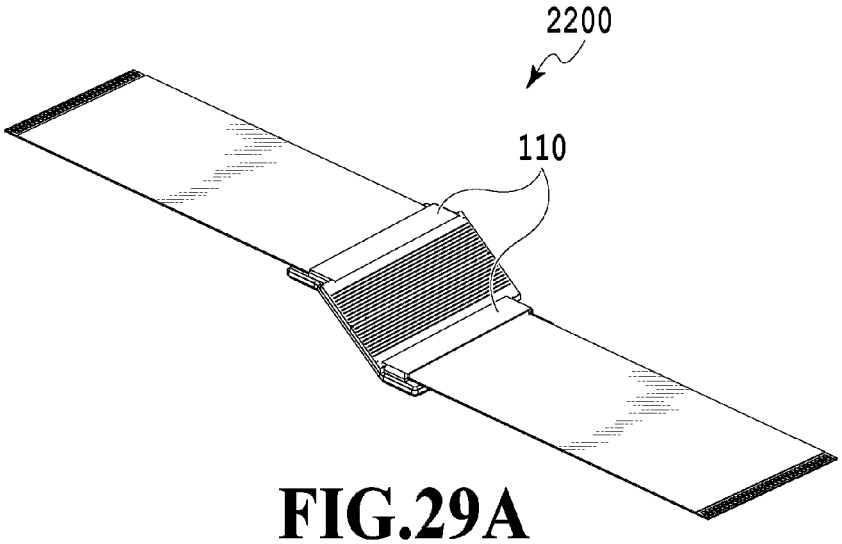
FIG. 29A is a perspective view illustrating one ejection module.
Figure 29B:
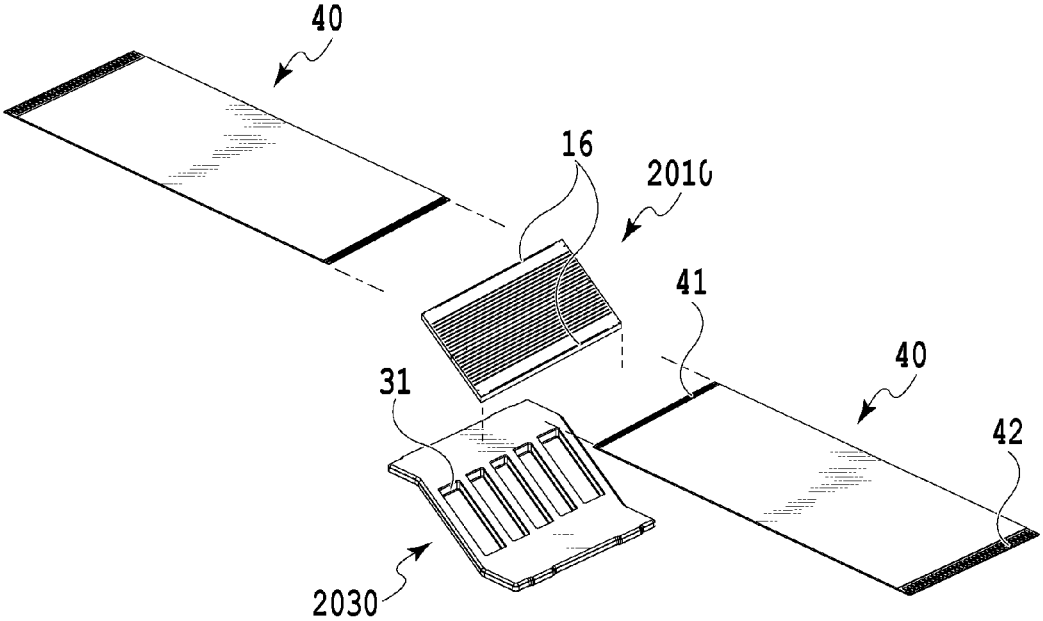
FIG. 29B is an exploded perspective view of the ejection module.

FIG. 29A is a perspective view illustrating one ejection module 2200 and FIG. 29B is an exploded view thereof. A difference from the first embodiment is that the terminals 16 are respectively disposed at both sides (the long side portions of the print element board 2010) in the ejection opening row directions of the print element board 2010. Accordingly, two flexible circuit boards 40 electrically connected to the print element board 2010 are disposed for each print element board 2010. Since the number of the ejection opening rows provided in the print element board 2010 is twenty, the ejection opening rows are more than eight ejection opening rows of the first embodiment. Here, since a maximal distance from the terminal 16 to the print element is shortened, a decrease in voltage or a delay of a signal generated in the wiring portion inside the print element board 2010 is reduced. Further, the liquid communication opening 31 of the support member 2030 is opened along the entire ejection opening row provided in the print element board 2010. The other configurations are similar to those of the first embodiment.

(Description of Structure of Print Element Board)

FIG. 30A is a schematic diagram illustrating a face on which the ejection opening 13 is disposed in the print element board 2010 and FIG. 30C is a schematic diagram illustrating a rear face of the face of FIG. 30A. FIG. 30B is a schematic diagram illustrating a face of the print element board 2010 when a lid member 2020 provided in the rear face of the print element board 2010 in FIG. 30C is removed. As illustrated in FIG. 30B, the liquid supply path 18 and the liquid collection path 19 are alternately provided along the ejection opening row direction at the rear face of the print element board 2010.

The number of the ejection opening rows is larger than that of the first embodiment. However, a basic difference from the first embodiment is that the terminal 16 is disposed at both sides of the print element board in the ejection opening row direction as described above. A basic configuration is similar to the first embodiment in that a pair of the liquid supply path 18 and the liquid collection path 19 is provided in each ejection opening row and the lid member 2020 is provided with the opening 21 communicating with the liquid communication opening 31 of the support member 2030.

In addition, the description of the above-described embodiment does not limit the scope of the invention. As an example, in the embodiment, a thermal type has been described in which bubbles are generated by a heating element to eject the liquid. However, the invention can be also applied to the liquid ejection head which employs a piezo type and the other various liquid ejection types.

Further, in the above-described embodiments, in a case where the ink charging operation and the recovery operation of the printing head are performed, a liquid which is different from the ink used for the printing operation and called a stored liquid or an initially charged liquid with high fluidity, for example, a liquid with high wettability may be charged and may be replaced by the ink used for the printing operation.

In the embodiment, the inkjet printing apparatus (the printing apparatus) has been described in which the liquid such as ink is circulated between the tank and the liquid ejection head, but the other embodiments may be also used. In the other embodiments, for example, a configuration may be employed in which the ink is not circulated and two tanks are provided at the upstream side and the downstream side of the liquid ejection head so that the ink flows from one tank to the other tank. In this way, the ink inside the pressure chamber may flow.

In the embodiment, an example of using a so-called line type head having a length corresponding to the width of the print medium has been described, but the invention can be also applied to a so-called serial type liquid ejection head which prints an image on the print medium while scanning the print medium. As the serial type liquid ejection head, for example, the liquid ejection head may be equipped with a print element board ejecting black ink and a print element board ejecting color ink, but the invention is not limited thereto. That is, a liquid ejection head which is shorter than the width of the print medium and includes a plurality of print element boards disposed so that the ejection openings overlap each other in the ejection opening row direction may be provided and the print medium may be scanned by the liquid ejection head.

Further, in the third and fourth embodiments, a case has been described in which the deaeration module and the depressurization pump (the depressurization unit) are used to configure the deaeration unit that decreases the dissolved oxygen amount (the dissolved gas amount) of the ink. However, the deaeration unit of the third and fourth embodiments may be configured as the deaeration tank illustrated in the second embodiment to perform the deaeration operation and the circulation operation similarly to the second embodiment. Accordingly, similarly to the second embodiment, it is possible to remove the bubbles and to shorten a time until the printing operation starts after the printing start signal is input to the controller. Further, since the deaeration unit corresponding to each of the liquid ejection heads can be provided at low cost, this configuration is particularly effective for the fourth embodiment that uses a plurality of ejection heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-032351, filed Feb. 23, 2016, which is hereby incorporated by reference wherein in its entirety.

What is claimed is:

1. A liquid ejection apparatus comprising:

a liquid ejection head configured to perform a printing operation on a printing medium by ejecting a liquid from an ejection opening formed in the liquid ejection head;

a liquid supply source;

a circulation unit configured to circulate the liquid inside a circulation passage extending from the liquid supply source, through the liquid ejection head, and to the liquid supply source;

a deaeration unit configured to perform a deaeration operation to decrease an amount of dissolved gas in the liquid to a dissolved gas amount;

a recovery unit configured to perform a recovery operation of discharging the liquid from the ejection opening in order to recover liquid ejection performance from the ejection opening; and a control unit configured to control an operation of driving the circulation unit and the deaeration unit, the control unit being configured to start the deaeration operation and circulate the liquid, having been deaerated by the deaeration operation, inside the circulation path after the recovery operation and before an initial printing operation after the recovery operation.

2. The liquid ejection apparatus according to claim 1, wherein the recovery operation is a recovery operation performed after the liquid is charged into the liquid ejection head.

3. The liquid ejection apparatus according to claim 2, wherein the liquid is charged into the liquid ejection head after the liquid ejection apparatus is newly delivered or a printing head is replaced.

4. The liquid ejection apparatus according to claim 1, wherein the recovery operation is performed before a bubble generating time elapses, the bubble generating time being a time from a precedent recovery operation to the generation of bubbles affecting the ejection of the liquid by the liquid ejection head.

5. The liquid ejection apparatus according to claim 1, wherein the control unit controls the circulation unit so that the deaerated liquid is circulated until a diameter of a bubble remaining inside the circulation passage becomes smaller than a predetermined diameter.

6. The liquid ejection apparatus according to claim 5, wherein the predetermined diameter is set such that a maximal diameter of a bubble becomes smaller than a maximal dimension of a cross-section of each circulation passage.

7. The liquid ejection apparatus according to claim 5, wherein the predetermined diameter is 0.2 mm.

8. The liquid ejection apparatus according to claim 1, wherein the dissolved gas amount of the deaerated liquid is smaller than a saturated dissolved gas amount at a maximal temperature of the liquid ejection head in use.

9. The liquid ejection apparatus according to claim 1, wherein the deaeration unit includes a deaeration module and a depressurization unit depressurizing the deaeration module.

10. The liquid ejection apparatus according to claim 1, wherein the deaeration unit includes a tank serving as the liquid supply source and a depressurization unit depressurizing the inside of the tank.

11. The liquid ejection apparatus according to claim 10, wherein the control unit is further configured to (i) determine, when a printing start signal is received, whether an estimation value of an estimated amount of dissolved gas in the liquid in a printing operation to be executed in response to the printing start signal exceeds a threshold value of a predetermined dissolved gas amount, (ii) perform a printing operation in response to the printing start signal when the control unit determines that the estimation value is equal to or smaller than the threshold value, and (iii) perform a deaeration operation of deaerating the liquid inside the tank at a timing earlier than the printing operation when the control unit determines that the estimation value exceeds the threshold value.

12. The liquid ejection apparatus according to claim 11, wherein the control unit estimates the amount of dissolved gas from a time after the deaeration operation of deaerating the liquid in the tank ends until the circulation of the liquid starts, a liquid circulation time, a liquid temperature, and an amount of the liquid charged in the tank.

13. The liquid ejection apparatus according to claim 1, wherein the circulation of the deaerated liquid is performed while the ejection opening of the liquid ejection head is covered by a cap.

14. The liquid ejection apparatus according to claim 1, wherein the liquid ejection head allows the liquid inside the ejection opening to be flowable.

15. The liquid ejection apparatus according to claim 14, wherein the ejection head includes (a) an element generating energy used to eject the liquid and (b) a pressure chamber (i) having the element provided therein and (ii) configured to allow the liquid inside the pressure chamber to be circulated to the outside of the pressure chamber.

16. The liquid ejection apparatus according to claim 1, wherein the printing operation is performed in a state in which the liquid in a circulation passage is being circulated by the circulation unit.

17. The liquid ejection apparatus according to claim 1, wherein the liquid ejection head is a page-wide type liquid ejection head.

18. A liquid ejection method of performing a printing operation on a printing medium by ejecting a liquid from an ejection opening formed in a liquid ejection head, the liquid ejection method comprising:

a recovery step of performing a recovery operation of discharging the liquid from the ejection opening in order to recover liquid ejection performance from the ejection opening;

a deaeration step of performing a deaeration operation to decrease an amount of dissolved gas in the liquid after the recovery operation and before an initial printing operation after the recovery step; and a circulation step of circulating the liquid, having been deaerated by the deaeration operation, inside a circulation passage, the circulation passage extending from a liquid supply source, through the liquid ejection head, and to the liquid supply source.

19. The liquid ejection method according to claim 18, further comprising a print step of performing the printing operation by ejecting the liquid from the ejection opening in a state in which the deaerated liquid is being circulated in the circulation passage.

20. A liquid ejection apparatus comprising:

a liquid ejection head configured to perform a printing operation on a printing medium by ejecting a liquid from an ejection opening formed in the liquid ejection head, the ejection head including (a) an element generating energy used to eject the liquid and (b) a pressure chamber (i) having the element provided therein and (ii) configured to allow the liquid inside the pressure chamber to be circulated to the outside of the pressure chamber;

a liquid supply source;

a circulation unit configured to circulate the liquid inside a circulation passage extending from the liquid supply source, through the liquid ejection head, and to the liquid supply source;

a deaeration unit configured to perform a deaeration operation to decrease an amount of dissolved gas in the liquid to a dissolved gas amount;

a recovery unit configured to perform a recovery operation of discharging the liquid from the ejection opening in order to recover liquid ejection performance from the ejection opening; and a control unit configured to control an operation of driving the circulation unit and the deaeration unit, the control unit being configured to start the deaeration operation and circulate the liquid, having been deaerated by the deaeration operation, inside the circulation path after the recovery operation and before an initial printing operation after the recovery operation.

* * * * *